US010985502B2

(12) United States Patent
Kudo

(10) Patent No.: US 10,985,502 B2
(45) Date of Patent: Apr. 20, 2021

(54) CONNECTOR WITH PRY PREVENTING PROTRUSION

(71) Applicant: Sumitomo Wiring Systems, Ltd., Mie (JP)

(72) Inventor: Yasuhiro Kudo, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/682,471

(22) Filed: Nov. 13, 2019

(65) Prior Publication Data

US 2020/0161807 A1 May 21, 2020

(30) Foreign Application Priority Data

Nov. 19, 2018 (JP) ..... JP2018-216515

(51) Int. Cl.

| | |
|---|---|
| ***H01R 13/631*** | (2006.01) |
| ***H01R 13/506*** | (2006.01) |
| ***H01R 13/645*** | (2006.01) |
| *H01R 13/64* | (2006.01) |

(52) U.S. Cl.

CPC ..... *H01R 13/631* (2013.01); *H01R 13/506* (2013.01); *H01R 13/64* (2013.01); *H01R 13/645* (2013.01)

(58) Field of Classification Search

CPC .. H01R 12/7005; H01R 13/64; H01R 13/631; H01R 13/6456; H01R 13/645

USPC ..... 439/680

See application file for complete search history.

(56) References Cited

U.S. PATENT DOCUMENTS 1,157,026 A * 10/1915 Meschenmoser ..... H01R 24/28 439/252
3,594,698 A * 7/1971 Anhalt ..... H01R 13/6453 439/261
4,083,619 A * 4/1978 McCormick ..... H01R 13/62 439/310
4,232,930 A * 11/1980 Teti ..... H01R 13/502 439/680
5,554,045 A * 9/1996 Bethurum ..... H01R 13/6215 439/372
5,586,893 A * 12/1996 Mosquera ..... G06K 19/07735 439/108

(Continued)

FOREIGN PATENT DOCUMENTS

JP 2008-305607 12/2008

*Primary Examiner* — Renee S Luebke
*Assistant Examiner* — Paul D Baillargeon
(74) *Attorney, Agent, or Firm* — Gerald E. Hespos; Michael J. Porco; Matthew T. Hespos

(57) ABSTRACT

A connector (10) includes a first connector (20) and a second connector (50) to be connected to each other. The first connector (20) includes first terminals (21) and a first housing (23) configured to accommodate the first terminals (21). The second connector (50) includes second terminals (51) and a second housing (53) configured to accommodate the second terminals (51) and having a receptacle (54) to be fit to the first housing (23). A concave portion (30) is provided on a side of the first housing (23) to be fit to the second housing (53). The second housing (53) is provided with a pry preventing protrusion (62) projecting forwardly of the receptacle (54) and configured to suppress a positional deviation of the second housing (53) with respect to the first housing (23) by entering the concave portion (30) during a connecting operation.

7 Claims, 31 Drawing Sheets

(56) References Cited

U.S. PATENT DOCUMENTS

| | | | | | |
|---|---|---|---|---|---|
| 5,769,555 | A * | 6/1998 | Okada | H01R 13/422 | 403/14 |
| 5,871,371 | A * | 2/1999 | Rothenberger | H01R 9/038 | 439/579 |
| 8,585,429 | B2 * | 11/2013 | Rouillard | H01R 13/6278 | 439/378 |
| 8,628,350 | B2 * | 1/2014 | Briant | H01R 12/716 | 439/540.1 |
| 9,437,972 | B2 * | 9/2016 | Endo | H01R 13/645 | |
| 9,525,239 | B2 * | 12/2016 | Shinmi | H01R 13/631 | |
| 2012/0045945 | A1 * | 2/2012 | Tai | H01R 13/6456 | 439/680 |

* cited by examiner

CONNECTOR WITH PRY PREVENTING PROTRUSION

BACKGROUND

Field of the Invention

This specification relates to a connector.

Related Art

The expression "ply connection" refers to a connecting operation of a male connector and a female connector in postures inclined with respect to proper connecting postures. A pry connection can cause troubles due to contact of the connectors at positions where the connectors are not supposed to be in contact. Japanese Unexamined Patent Publication No. 2008-305607 discloses an assembly of a male connector and a female connector. The male connector has a receptacle and a lock receiving portion is on an outer surface of the receptacle. The female connector includes a lock arm for locking the male and female connectors in a connected state. The lock arm has a lock to be locked to the lock receiving portion and a pry preventing protrusion projects forward from the lock. The pry preventing protrusion interferes with the lock receiving portion when a connecting operation is performed with the connectors held in postures inclined with respect to proper connecting postures, thereby preventing troubles caused by the pry connection.

In this configuration, the pry preventing protrusion of the lock arm must be brought into contact with the lock receiving portion on the outer surface of the receptacle to prevent the pry connection. Thus, the receptacle has to be enlarged to a position where the pry preventing protrusion interferes with the lock receiving portion. Therefore, the configuration of the connector is not easily simplified.

This specification was completed in view of the above situation and aims to suppress pry connection while simplifying the configuration of a connector.

SUMMARY

A connector disclosed in this specification has a first connector and a second connector to be connected to each other. The first connector includes a first terminal and a first housing configured to accommodate the first terminal. The second connector includes a second terminal, a second housing configured to accommodate the second terminal and a receptacle to be fit to the first housing. A concave portion is provided on a side of the first housing that is to be fit to the second housing. The second housing has a pry preventing protrusion projecting forward of the receptacle and configured to suppress a positional deviation of the second housing with respect to the first housing by entering the concave portion during a connecting operation.

According to this configuration, the pry preventing protrusion projects forward of the receptacle of the second housing. Thus, a positional deviation of the second connector with respect to the first connector can be suppressed by inserting the pry preventing protrusion into the concave portion during the connecting operation. Accordingly, troubles caused by a pry connection are avoided without enlarging the receptacle. The pry connection can be suppressed while the configuration of the connector is simplified.

The second housing may include a partition configured to partition the inside of the receptacle, and the pry preventing protrusion may be provided on a front part of the partition. The partition enhances the strength of the pry preventing protrusion while simplifying the configuration of the second housing.

The concave portion may have a guide extending in a connecting direction of the first housing and the second housing, and the pry preventing protrusion may be formed with a guided portion to be guided by being engaged with the guide when the first housing and the second housing are connected. Thus, the connectors can be guided in the connecting direction by utilizing the configuration of the pry preventing protrusion.

An inclined surface may be formed on an inner wall of the concave portion to guide the pry preventing protrusion into the concave portion by coming into contact with a tip of the pry preventing protrusion. Thus, the pry preventing protrusion can be guided into the concave portion by the inclined surface when the connectors are connected.

The first housing may be fixed to a case of a device, and the second housing may be inserted into an insertion hole penetrating through the case. A clearance may be set between an inner wall of the insertion hole and an outer surface of the second housing so that the pry preventing protrusion comes into contact with the concave portion. Thus, the second connector can be inserted easily into the insertion hole due to the clearance between the second connector and the inner wall of the insertion hole during a fitting operation of the second connector. Accordingly, the pry connection can be suppressed by the pry preventing protrusion contacting the concave portion even if the second connector is inclined or positionally deviated due to the clearance.

According to the invention, it is possible to suppress a pry connection while simplifying the configuration of a connector.

DETAILED DESCRIPTION

An embodiment is described with reference to FIGS. 1 to 31.

Figure 1:
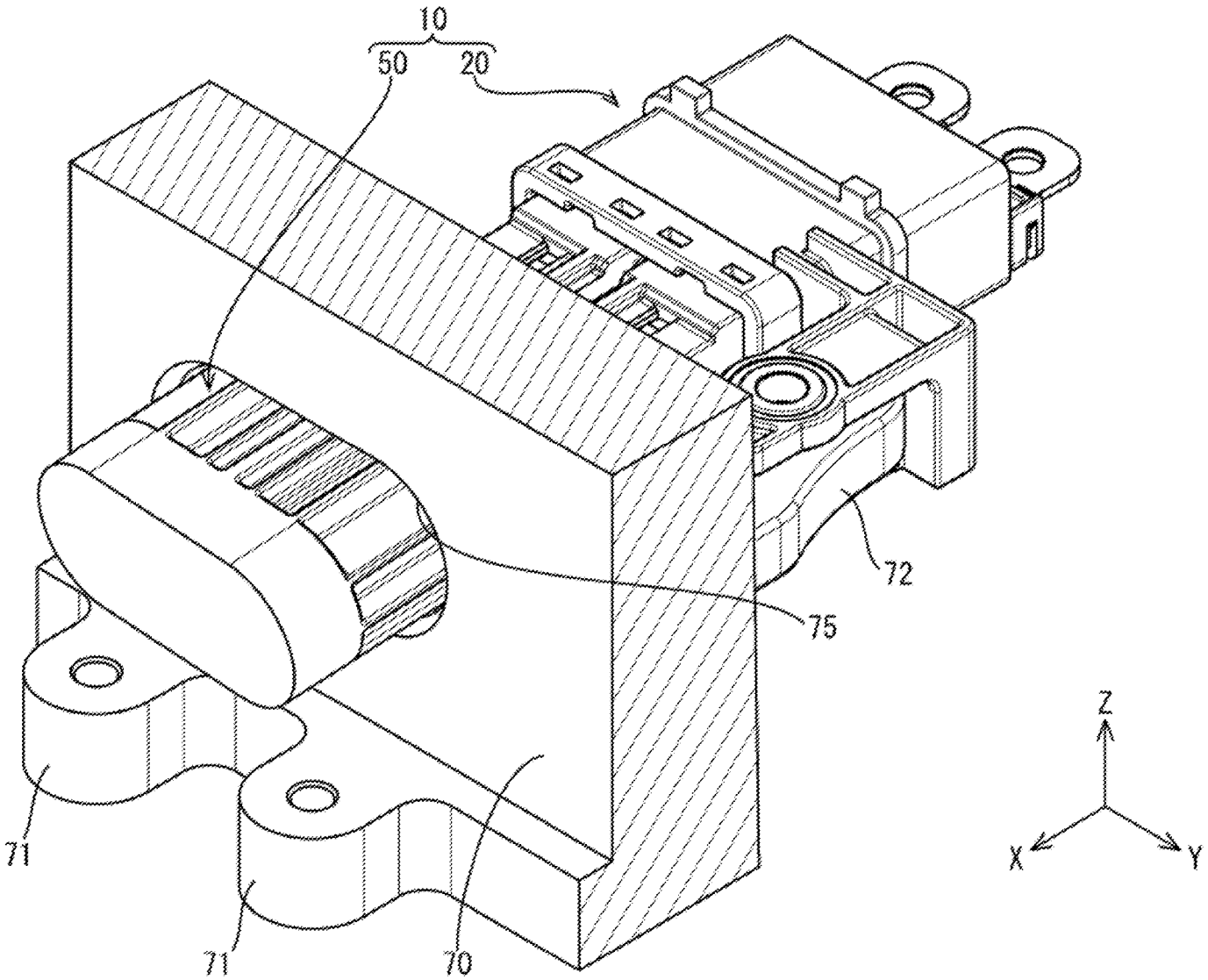
FIG. 1 is a perspective view showing a state where a connector of an embodiment is mounted on a case of a device.
Figure 2:
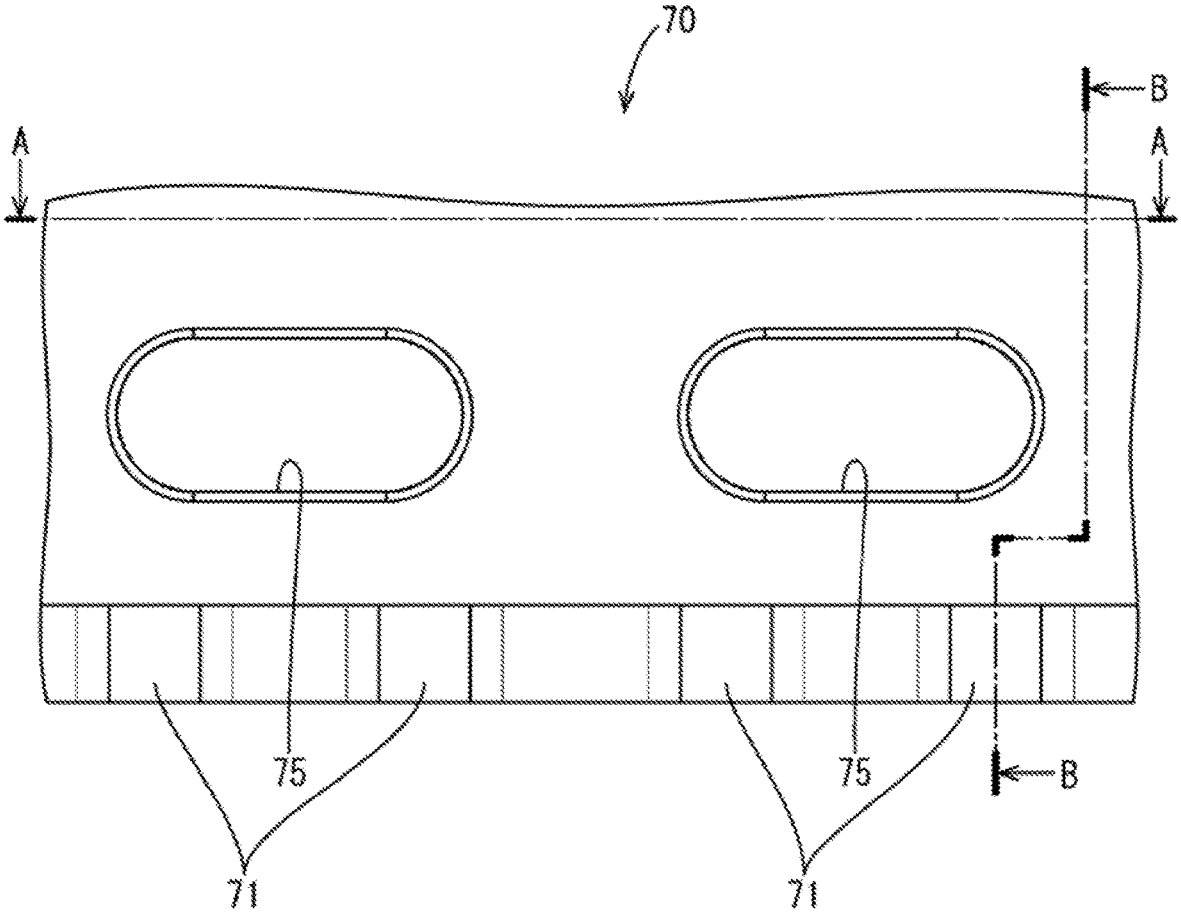
FIG. 2 is a back view of the case.

A connector 10 of this embodiment is disposed in a power supply path of a vehicle such as an automotive vehicle and, as shown in FIG. 1, is mounted on a case 70 (only a part of the case 70 on the side of the connector 10 is shown and the other part is not shown in FIG. 1 and other figures) of a device and includes a first connector 20 and a second connector 50 to be connected to the first connector 20. In the following description, a connecting direction of the connectors 20, 50 is referred to as a forward direction and a Y direction and a Z direction of FIG. 1 are referred to as a leftward direction and an upward direction.

Figure 3:
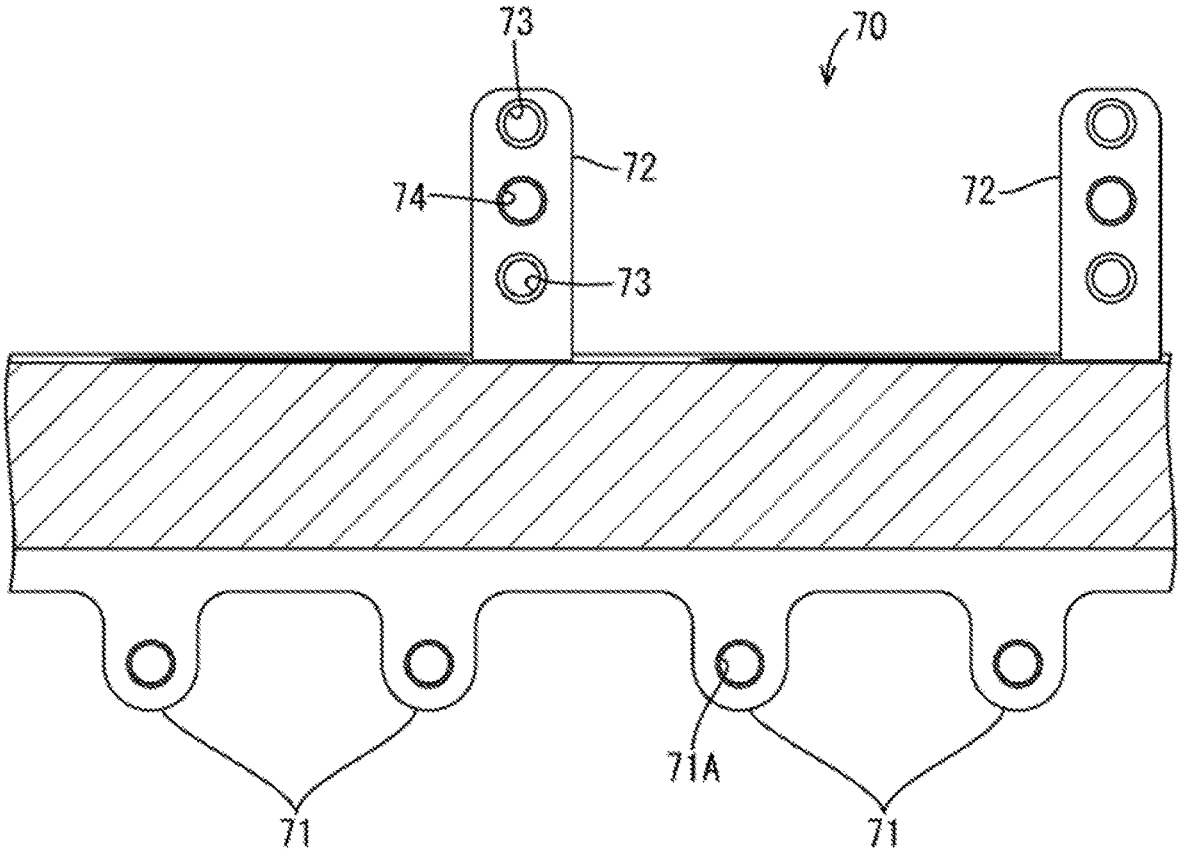
FIG. 3 is a section along A-A of FIG. 2.
Figure 4:
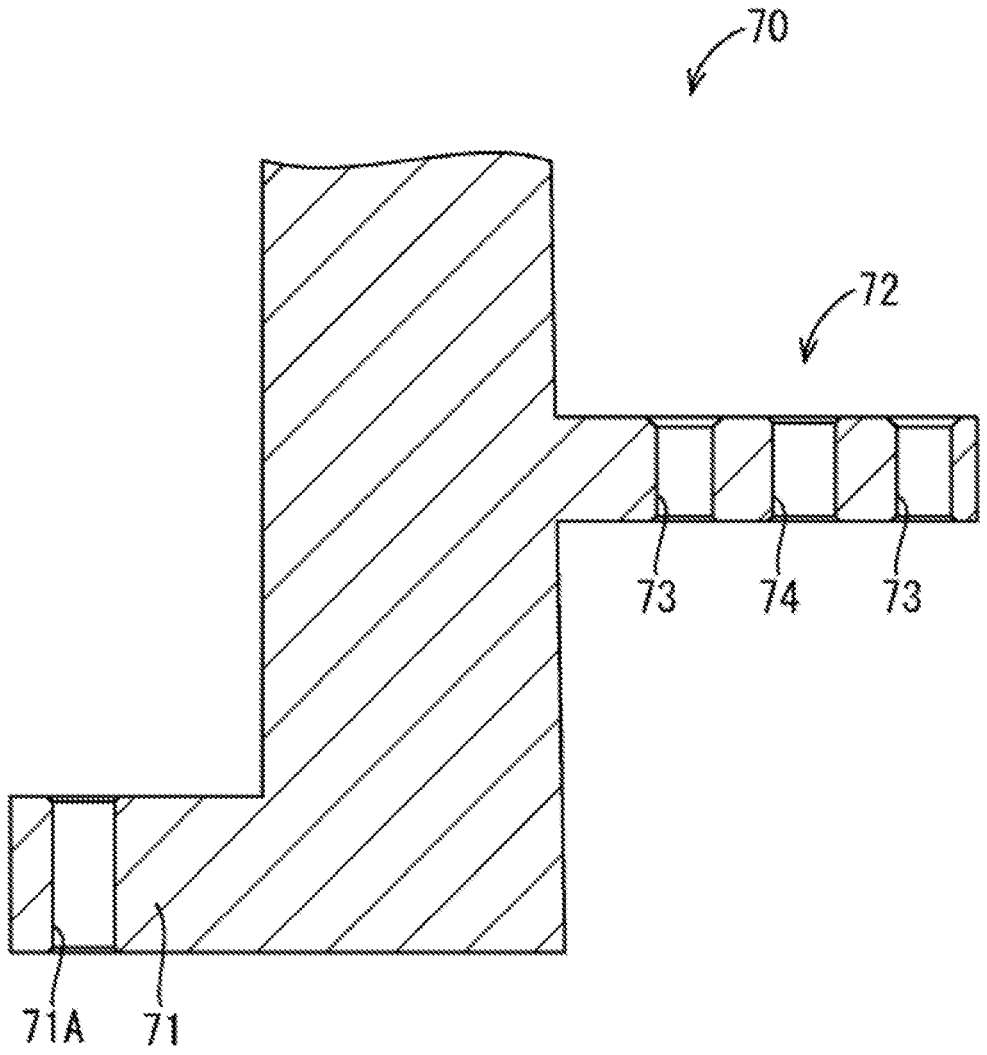
FIG. 4 is a section along B-B of FIG. 2.
Figure 5:
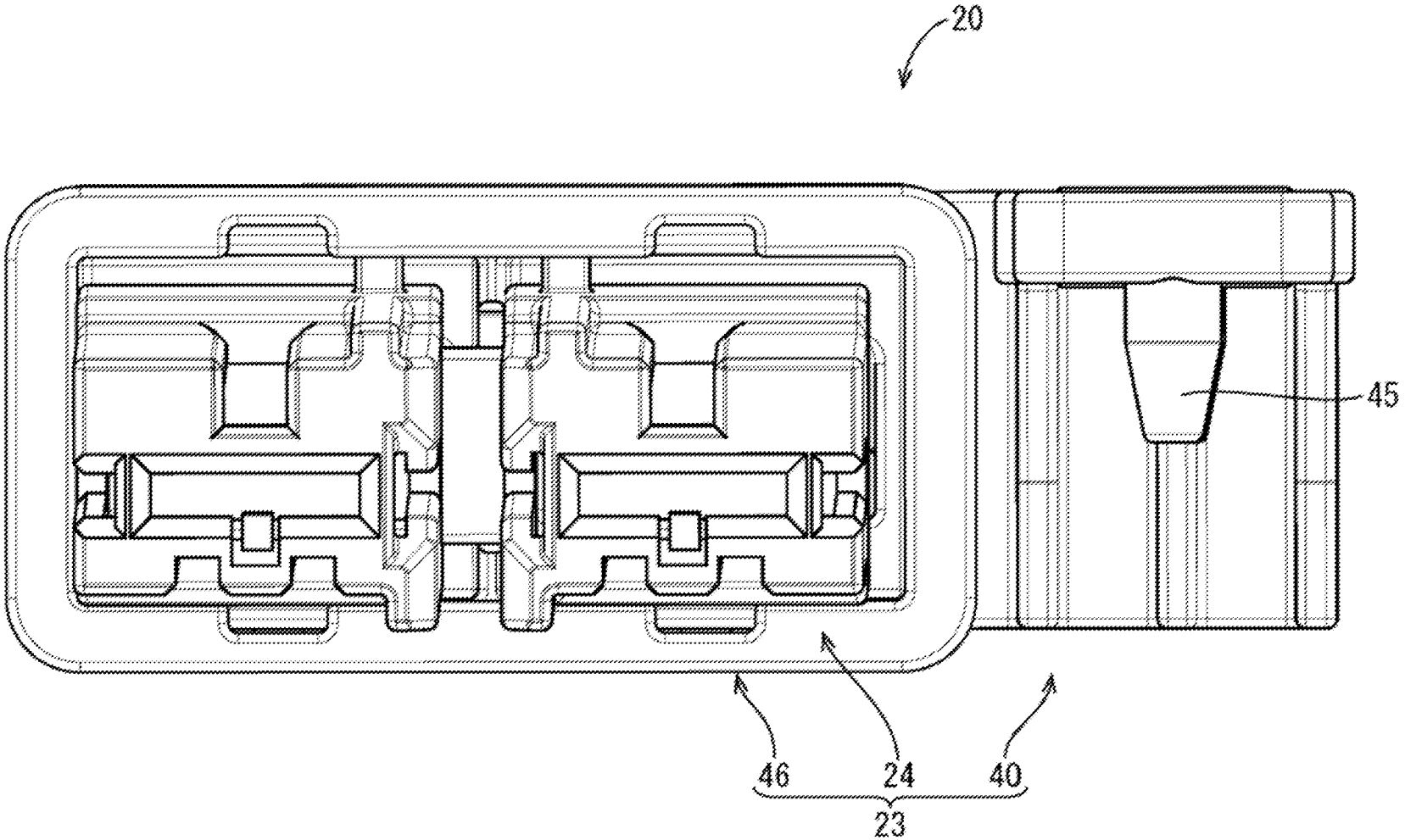
FIG. 5 is a front view showing a first connector.
Figure 6:
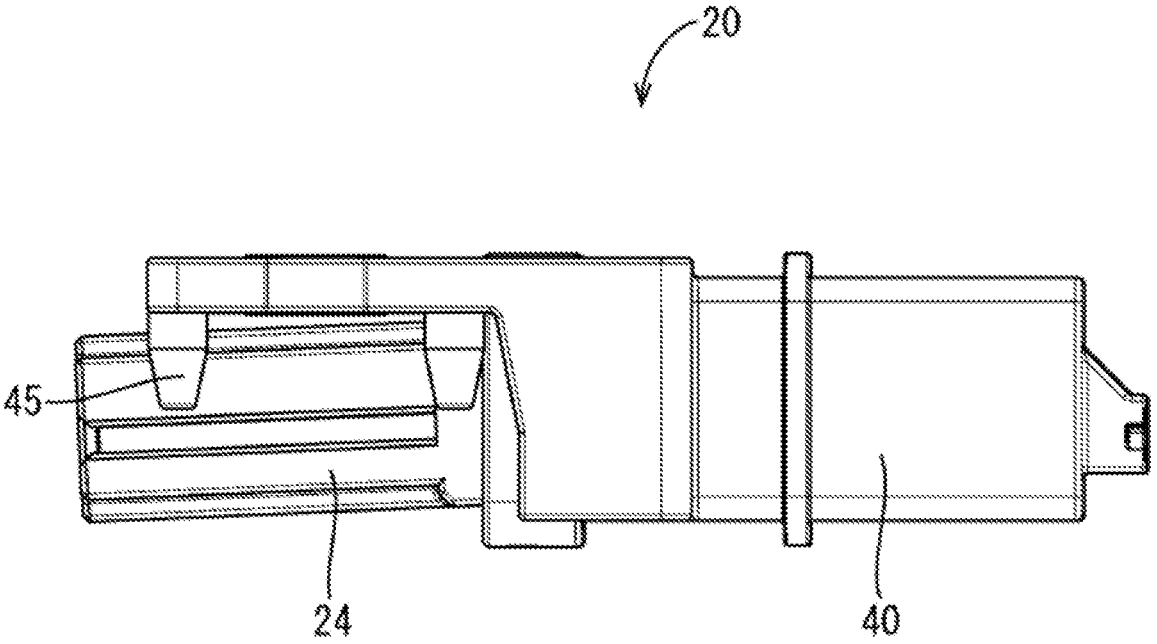
FIG. 6 is a side view showing the first connector.

The case 70 is made, for example, of metal and a power storage module (not shown), such as a battery or a capacitor, is accommodated inside the case 70 on the side of the first connector 20. The case 70 is formed with an elliptical penetrating insertion hole 75 through which the second connector 50 is inserted. The insertion hole 75 is formed such that a lateral diameter is larger than a vertical diameter. As shown in FIGS. 3 and 4, the case 70 includes vehicle fixing portions 71 to be fixed to a metal frame or the like of the vehicle by being fastened with screws. Connector mounting portions 72 extend in a direction perpendicular to an inner surface of the case 70, and the first connector 20 is mounted on the connector mounting portion 72. The vehicle fixing portions 71 are formed with through holes 71A through which shafts of the screws are inserted, and the connector mounting portion 72 is formed with two pin insertion holes 73 and a fastening hole 74 disposed between the pin insertion holes 73.

(First Connector 20)

Figure 28:
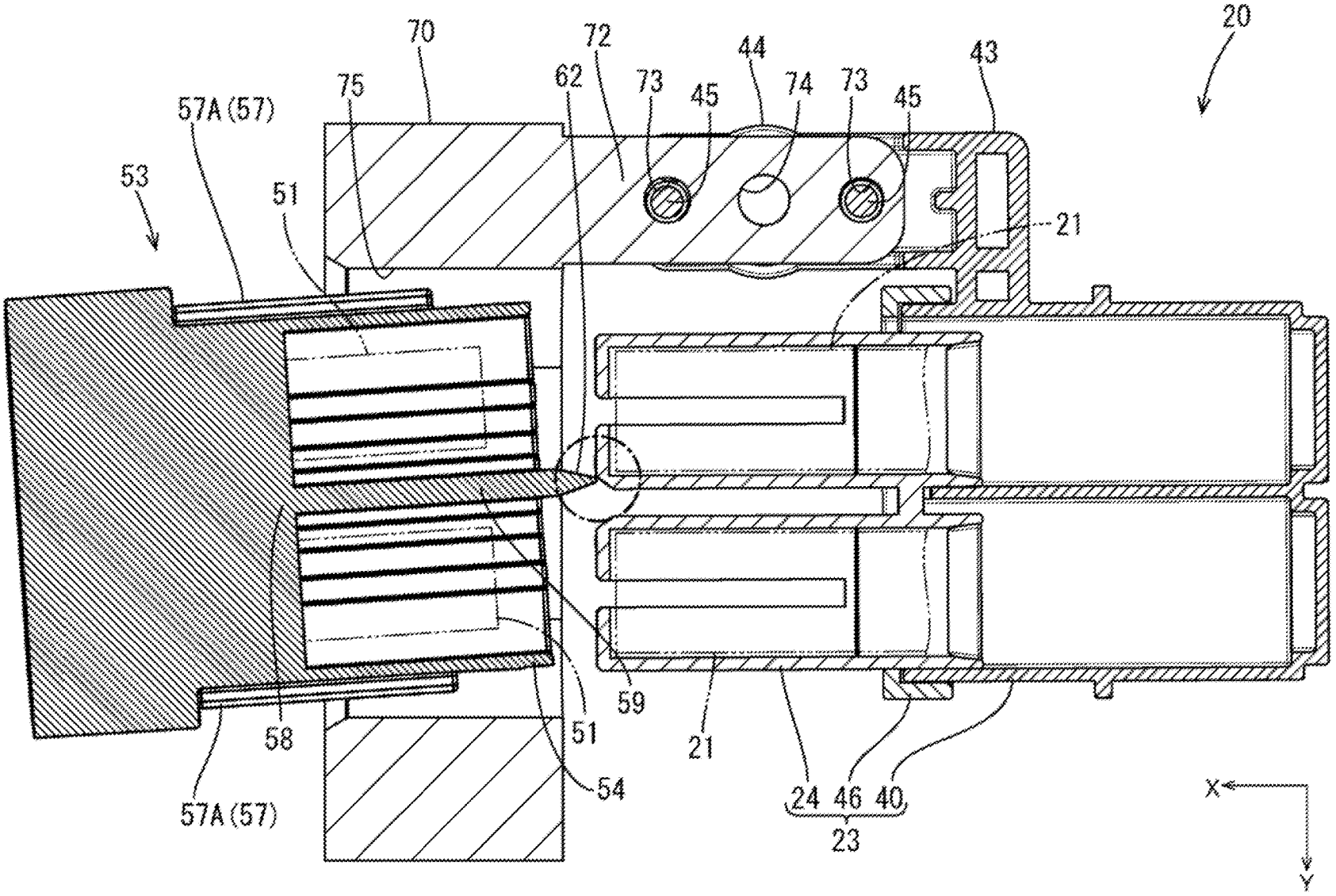
FIG. 28 is a section along F-F of FIG. 27.

As shown in FIG. 28, the first connector 20 is a female connector and includes two first terminals 21 and a first housing 23 for accommodating the first terminals 21. Each first terminal 21 is a female terminal made of metal, such as copper, copper alloy, aluminum or aluminum alloy and has a box. A resilient contact piece is in the box and is to be brought into contact with a second terminal 51. A rear end of the first terminal 21 is connected to a wire or a busbar made of a metal plate material.

Figure 7:
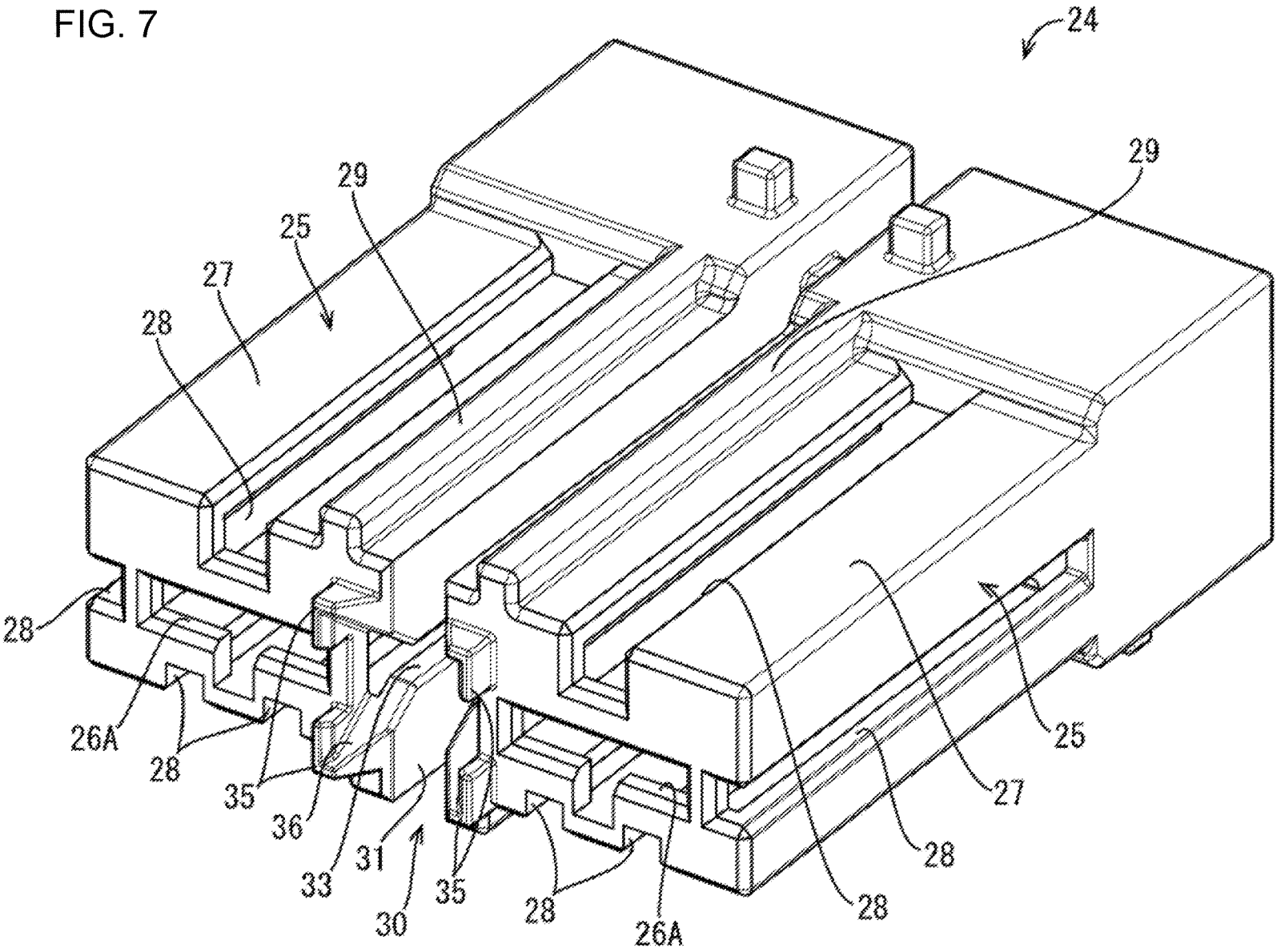
FIG. 7 is a perspective view showing a terminal accommodating member.
Figure 8:
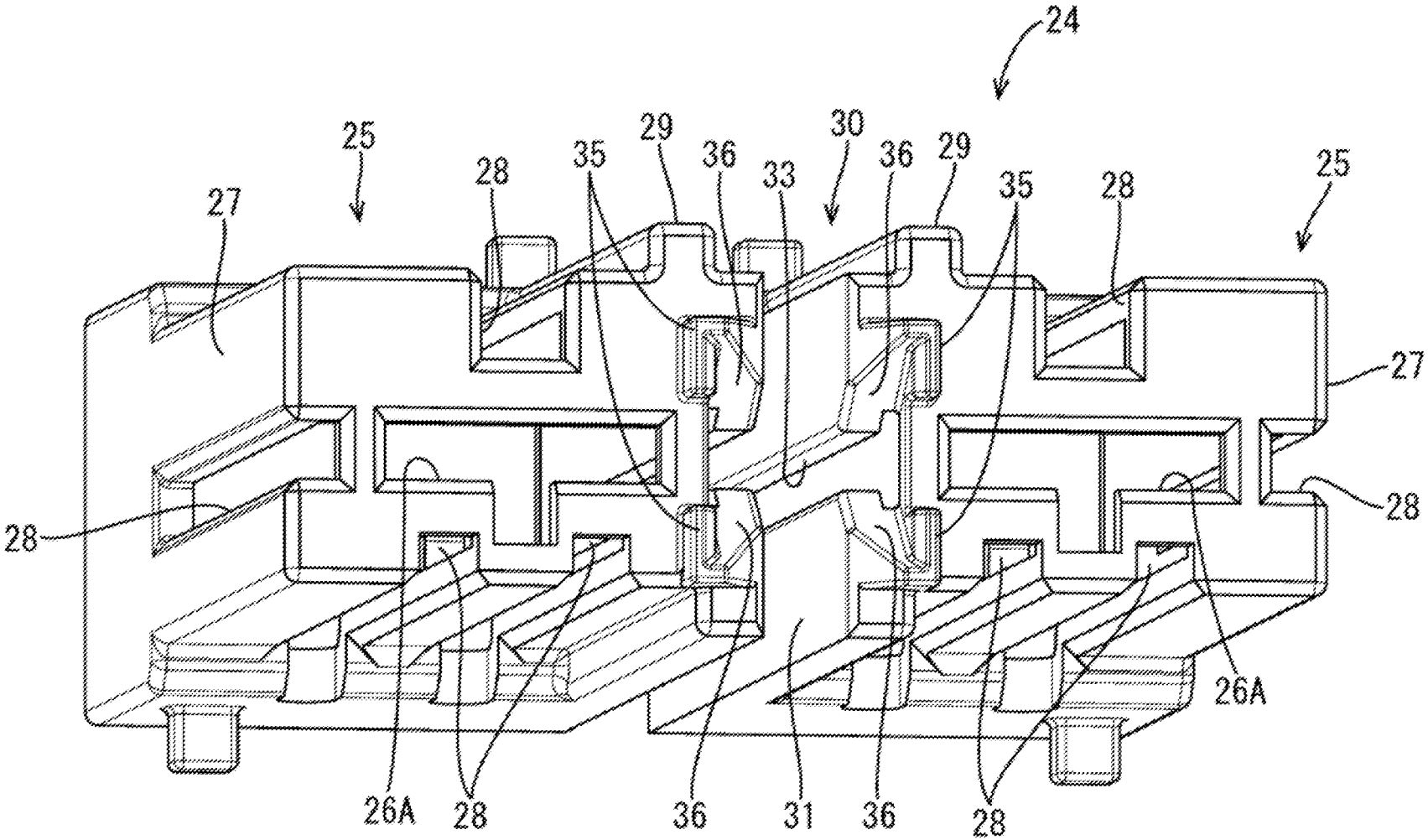
FIG. 8 is a perspective view showing the terminal accommodating member from a direction different from that of FIG. 7.
Figure 9:
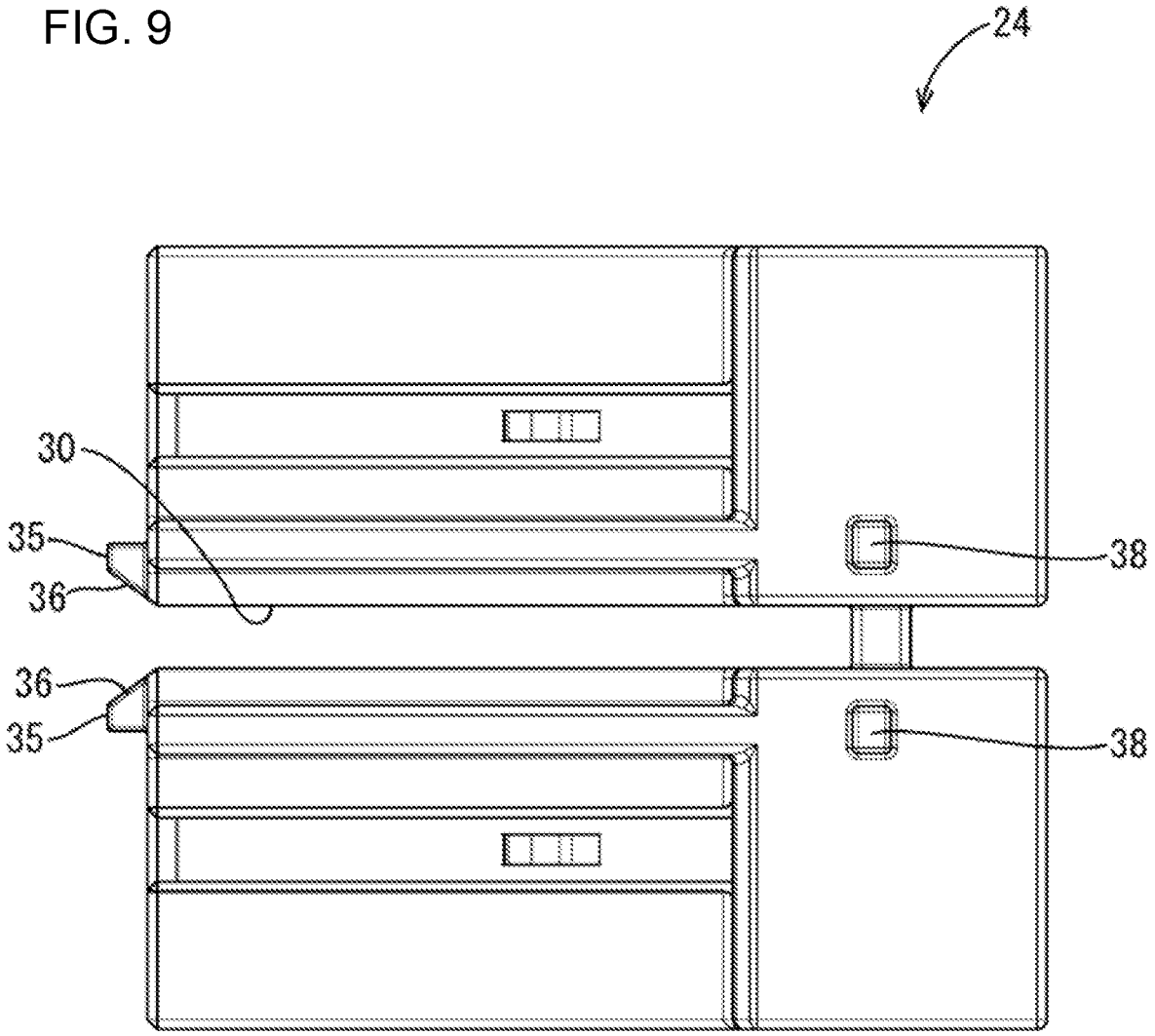
FIG. 9 is a plan view of the terminal accommodating member.
Figure 10:
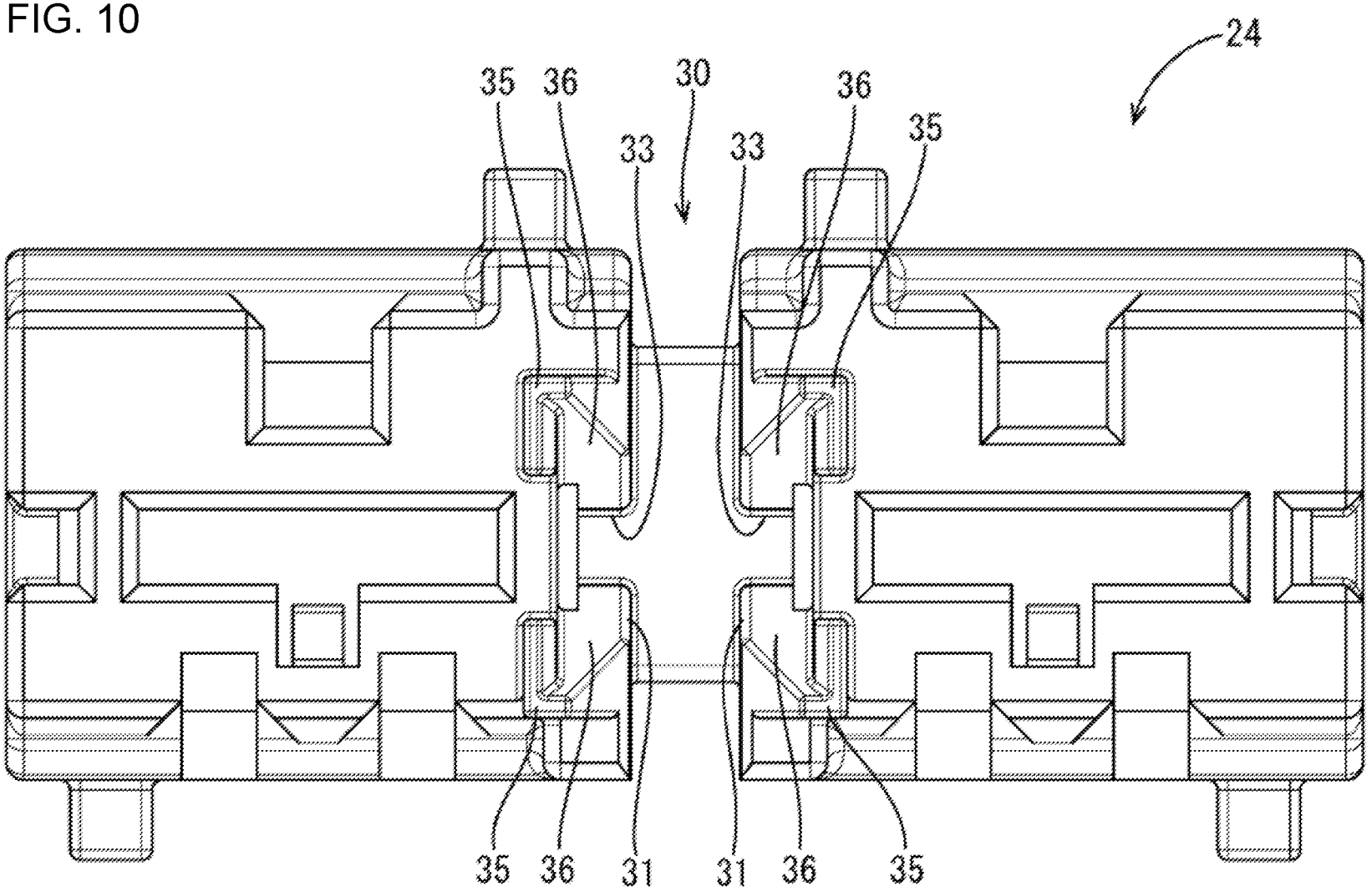
FIG. 10 is a front view showing the terminal accommodating member.
Figure 11:
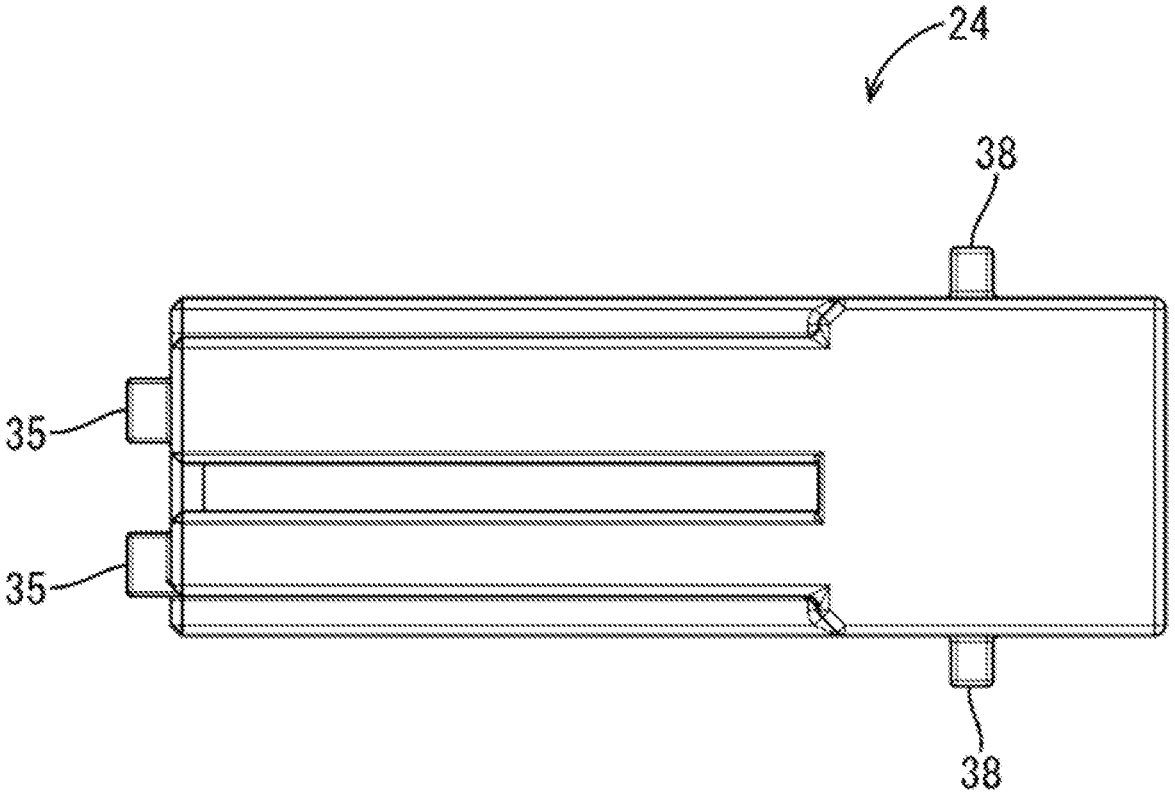
FIG. 11 is a side view showing the terminal accommodating member.

The first housing 23 includes a terminal accommodating member 24 to be fit into a receptacle 54 of a second housing 53 and configured to accommodate the two first terminals 21. An extending member 40 extends rearwardly of the terminal accommodating member 24, and a coupling 46 in the form of a rectangular tube couples the terminal accommodating member 24 and the extending member 40. The terminal accommodating member 24 is made of insulating synthetic resin and has two laterally arranged accommodation chambers 25 as shown in FIGS. 7 and 8 for accommodating the respective first terminals 21. Each accommodation chamber 25 includes a peripheral wall 27 in the form of a rectangular tube. Fit grooves 28 and fit ribs 29 extend in the connecting direction (front-rear direction) on the outer surface of the peripheral wall 27. Terminal insertion holes 26A through which the second terminals 51 are inserted penetrate through front walls 26 of the two accommodation chambers 25. Four L-shaped standing walls 35 project forward on inner edge parts of the front walls 26 of the two accommodation chambers 25. Two side walls 31 face each other behind the standing walls 35 to define a groove-like concave portion 30 into which a pry preventing protrusion 62 to be described later enters.

The concave portion 30 forms a gap (space) between the accommodation chambers 25. The four standing walls 35 are provided at corner positions of a rectangular space formed by the concave portion 30 in the front surfaces of the front walls 26. An inner side of each standing wall 35 (front end part of the concave portion 30) forms an inclined surface 36 obliquely cut with respect to the side wall 31. A guide groove 33 (an example of a "guide portion") extends in the connecting direction and penetrates through the side walls 31. The inclined surfaces 36 guide a tip of the pry preventing protrusion 62 to be described later into the inside of the concave portion 30 (into the guide groove 33 on a rear side of the concave portion 30).

Figure 12:
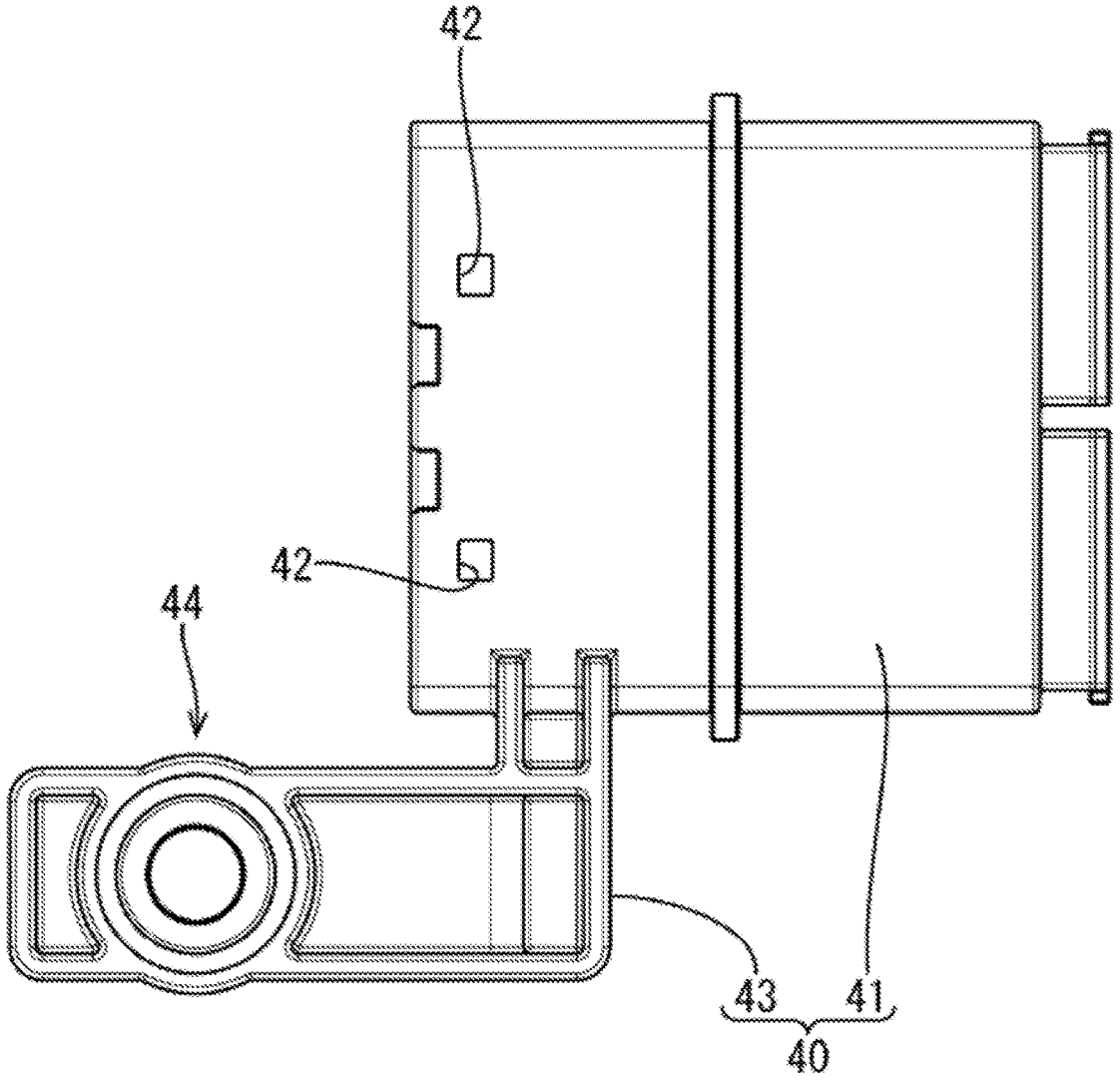
FIG. 12 is a plan view showing an extending member.
Figure 13:
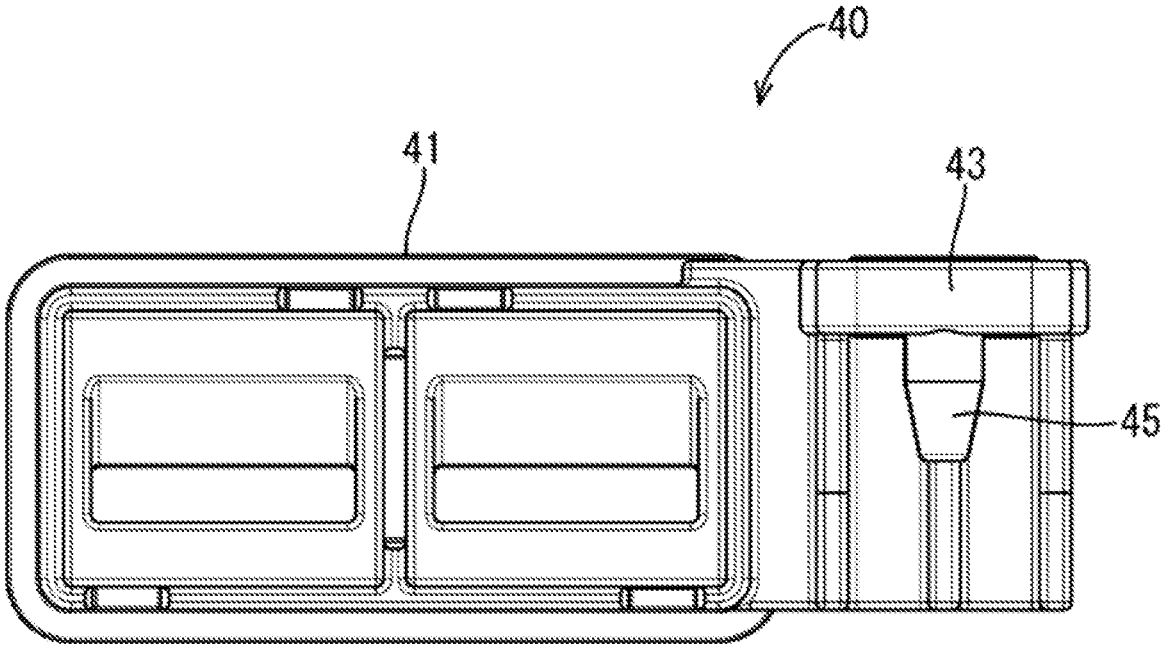
FIG. 13 is a front view showing the extending member.

The extending member 40 is made of metal or synthetic resin and includes, as shown in FIGS. 12 and 13, an extending body 41 in the form of a rectangular tube connected to and behind the terminal accommodating member 24 and an arm 43 integrally provided to the extending body 41 and fixed to the case 70 of the device. The arm 43 is fixed to a side surface of the extending member 41 on a base and is bent substantially at a right angle from this base to extend forward, and a fastening portion 44 having a hollow cylindrical collar made of metal is embedded therein and two pins 45 projecting on both sides of the fastening portion 44 are provided on a tip side. As shown in FIG. 28, the first housing 23 is mounted on the case 70 and the first connector 20 is held in position with respect to the case 70 by inserting a bolt (not shown) through the collar of the fastening portion 44 and the fastening hole 74 and fastening the bolt with the pins 45 inserted in the pin insertion holes 73 of the connector mounting portion 72.

Figure 14:
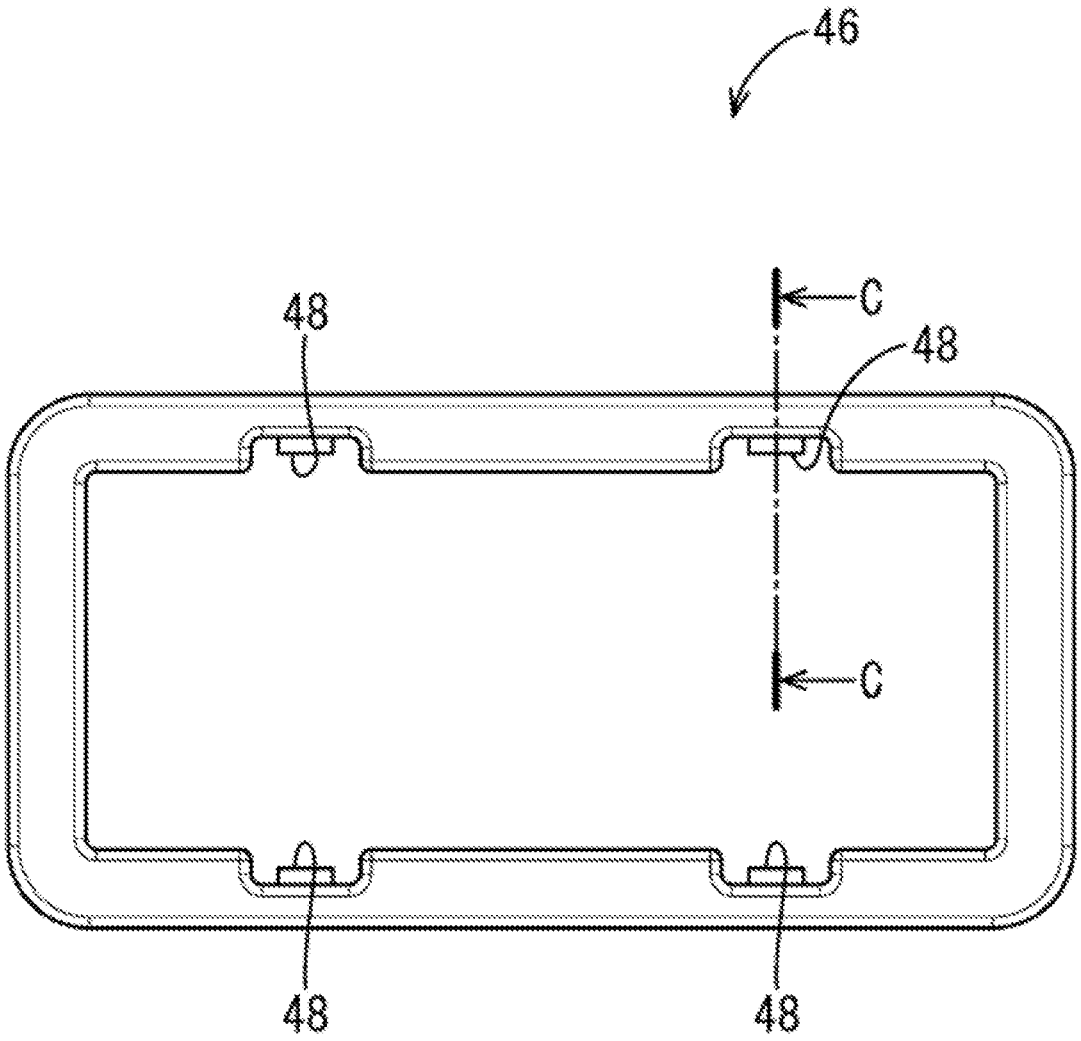
FIG. 14 is a front view showing a coupling member.
Figure 15:
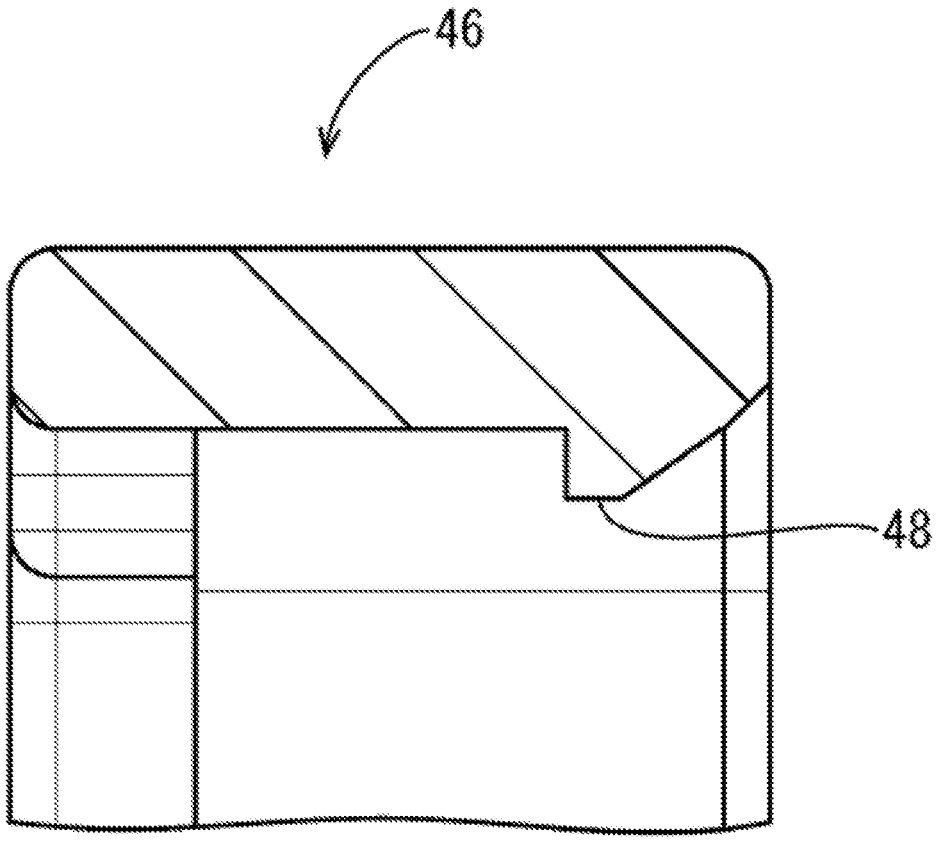
FIG. 15 is a section along C-C of FIG. 14.
Figure 24:
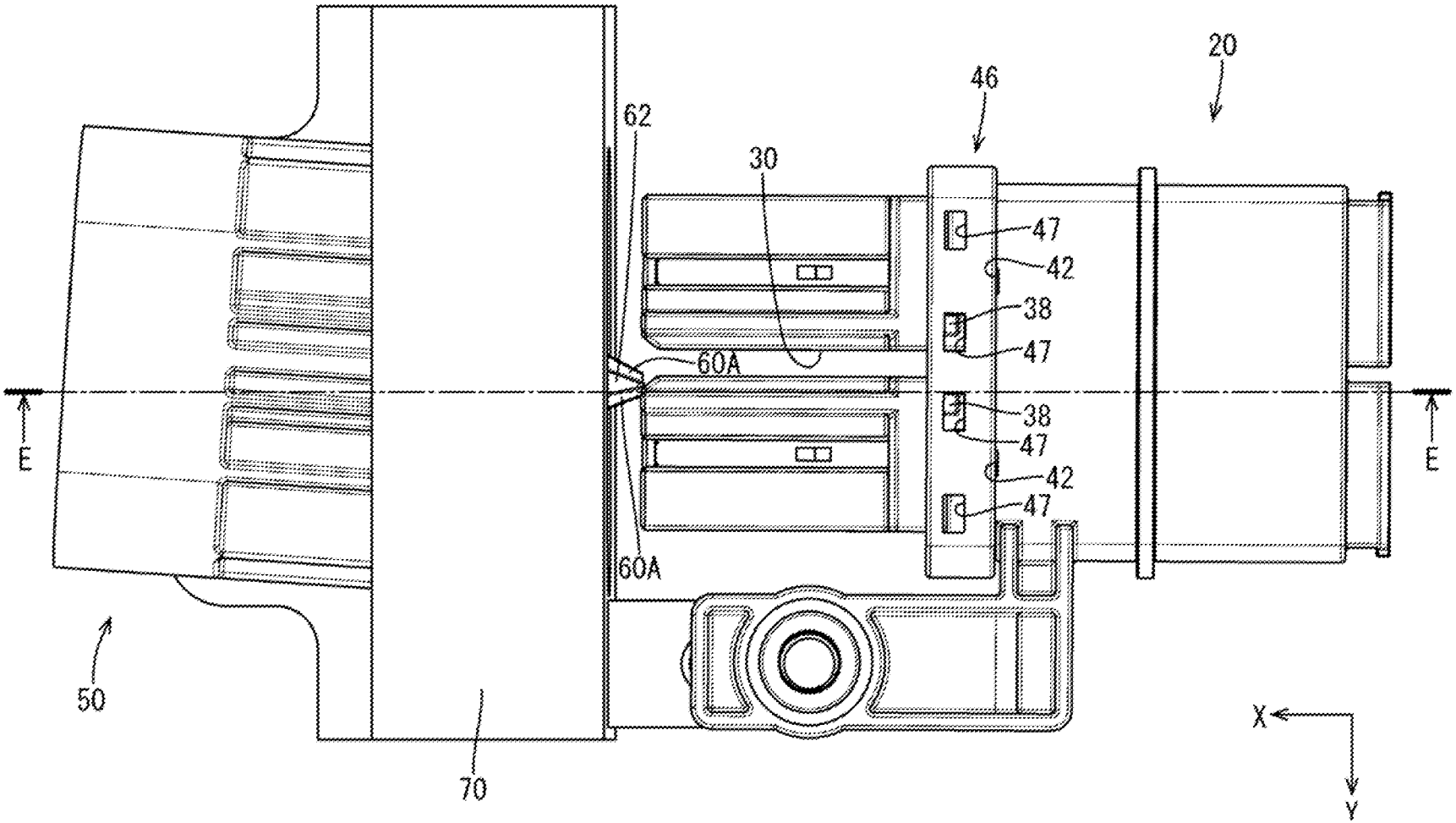
FIG. 24 is a plan view in a state where the pry preventing protrusion comes into contact with the inclined surface of the first housing during the connecting operation of the first connector and the second connector.

The coupling 46 is a frame made of synthetic resin and includes locking claws 48 projecting inward, as shown in FIGS. 14 and 15, and penetrating locking holes 47, as shown in FIG. 24. Walls of the locking holes 47 are locked to locking projections 38 projecting from the outer surface of the terminal accommodating member 24. Further, the locking claws 48 are locked to locking recesses 42 in the extending body 41. In this way, the terminal accommodating member 24 and the extending body 41 are held in a state coupled by the coupling member 46. Note that predetermined clearances are defined between the locking holes 47 and the locking projections 38, and a positional deviation, an angular positional deviation and rotation of the terminal accommodating member 24 with respect to the extending body 41 are allowed within a range corresponding to these clearances.

Figure 16:
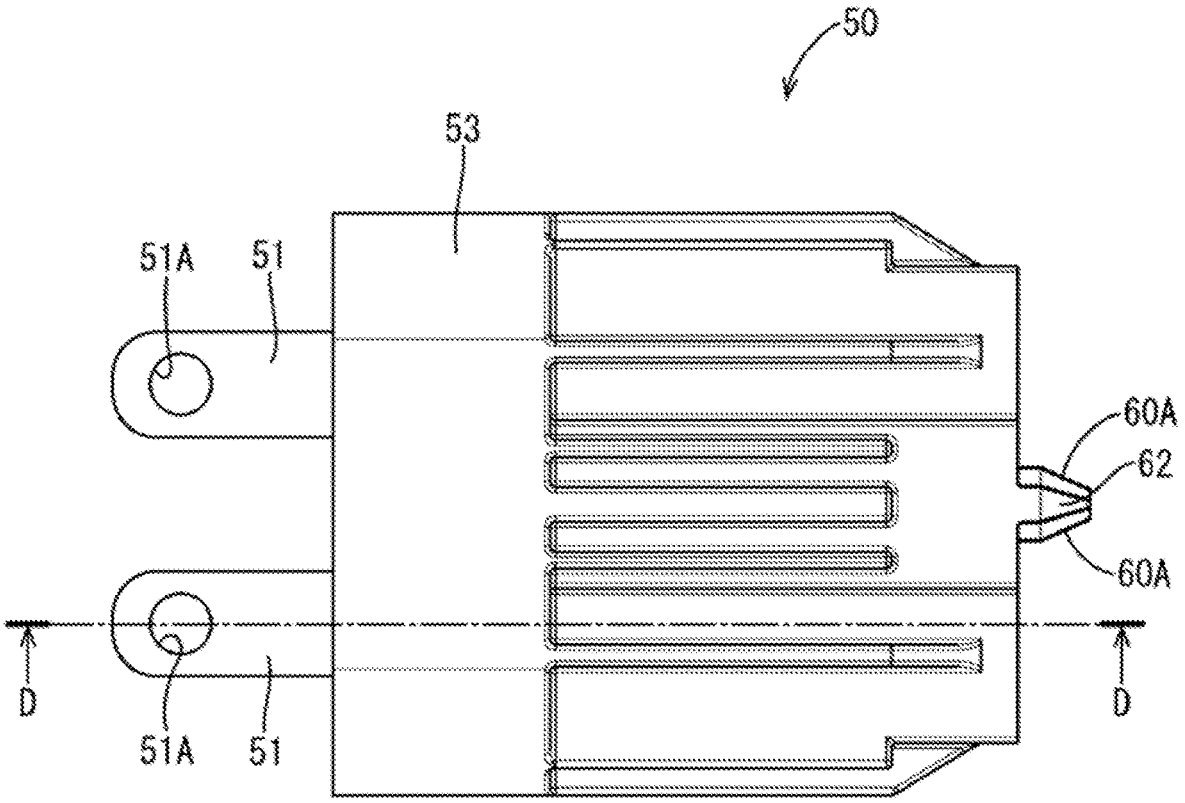
FIG. 16 is a plan view showing a second connector.
Figure 17:
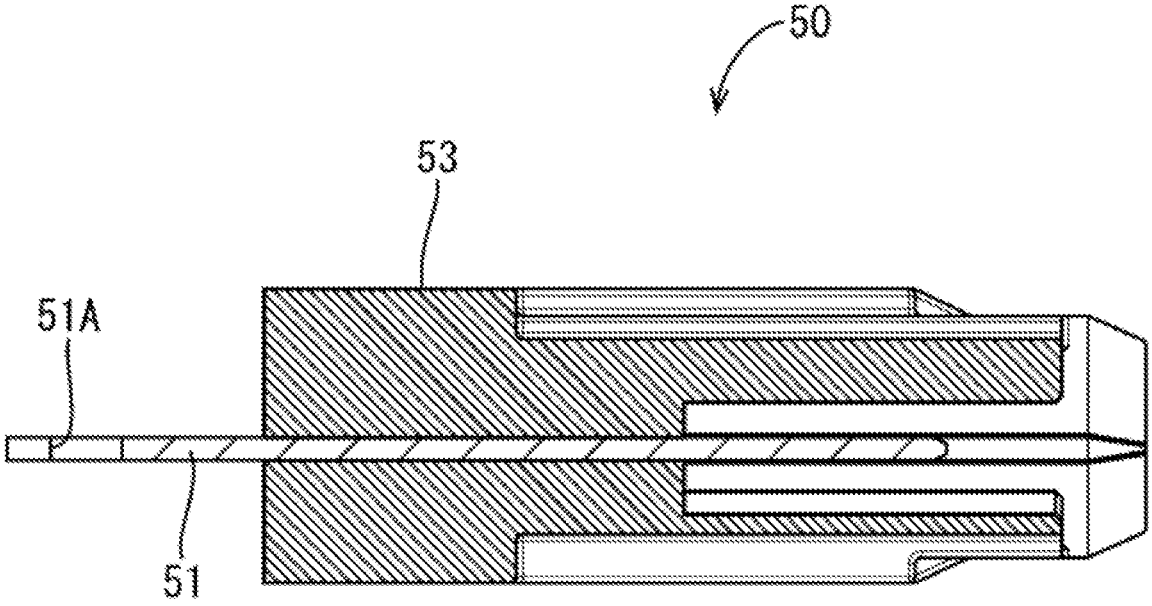
FIG. 17 is a section along D-D of FIG. 16.
Figure 18:
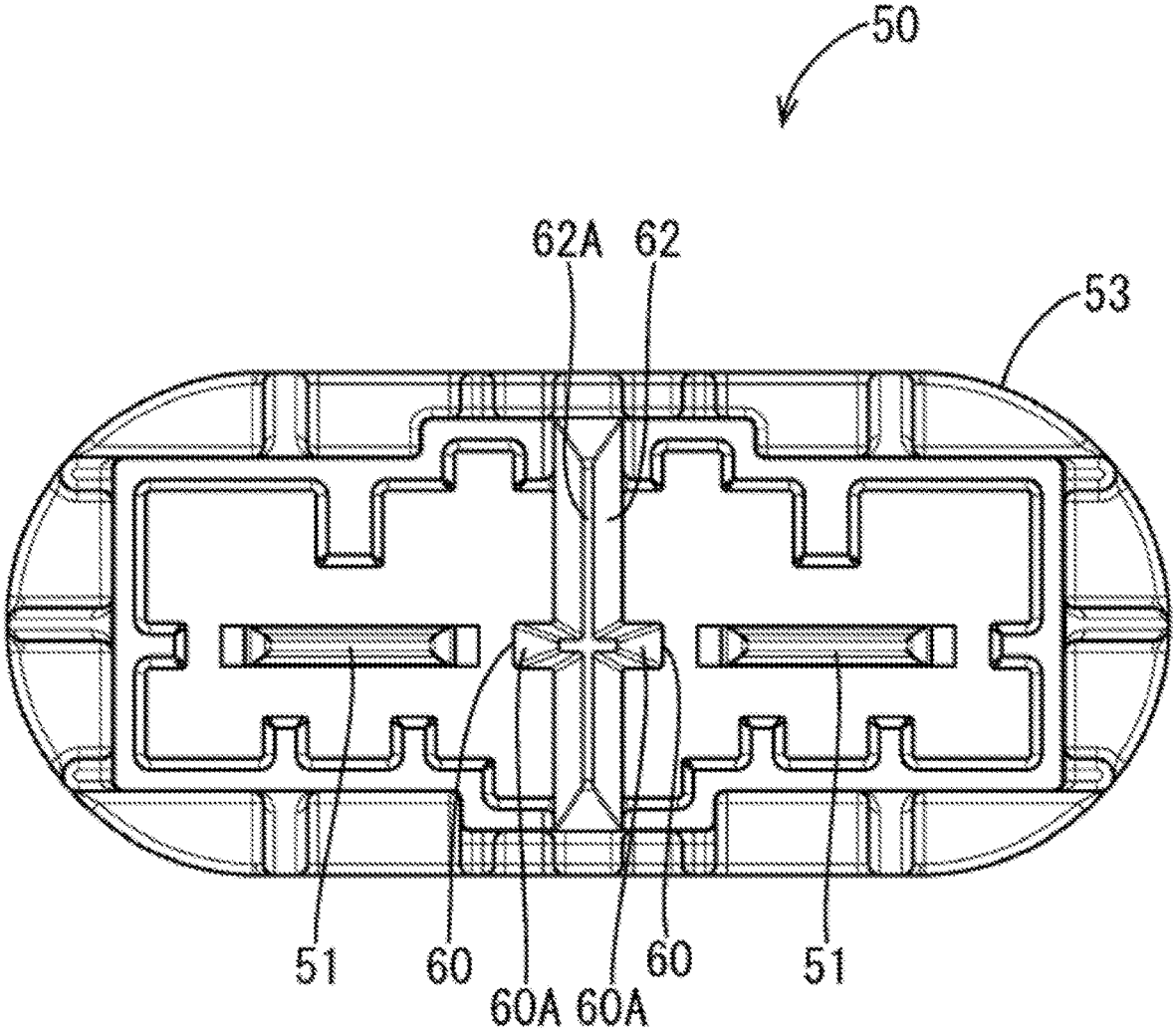
FIG. 18 is a front view showing the second connector.

As shown in FIGS. 16 and 17, the second connector 50 is a male connector and includes two second terminals 51 and the second housing 53 for accommodating the two second terminals 51. The second terminal 51 is a male terminal in the form of a flat plate (male tab) and is made of metal such as copper, copper alloy, aluminum or aluminum alloy. A rear side of the second terminal 51 is formed with a through hole 51A and is connectable to a terminal or the like on an end part of a wire (not shown). The wire is connected, for example, to an external inverter, charging connector or the like.

Figure 19:
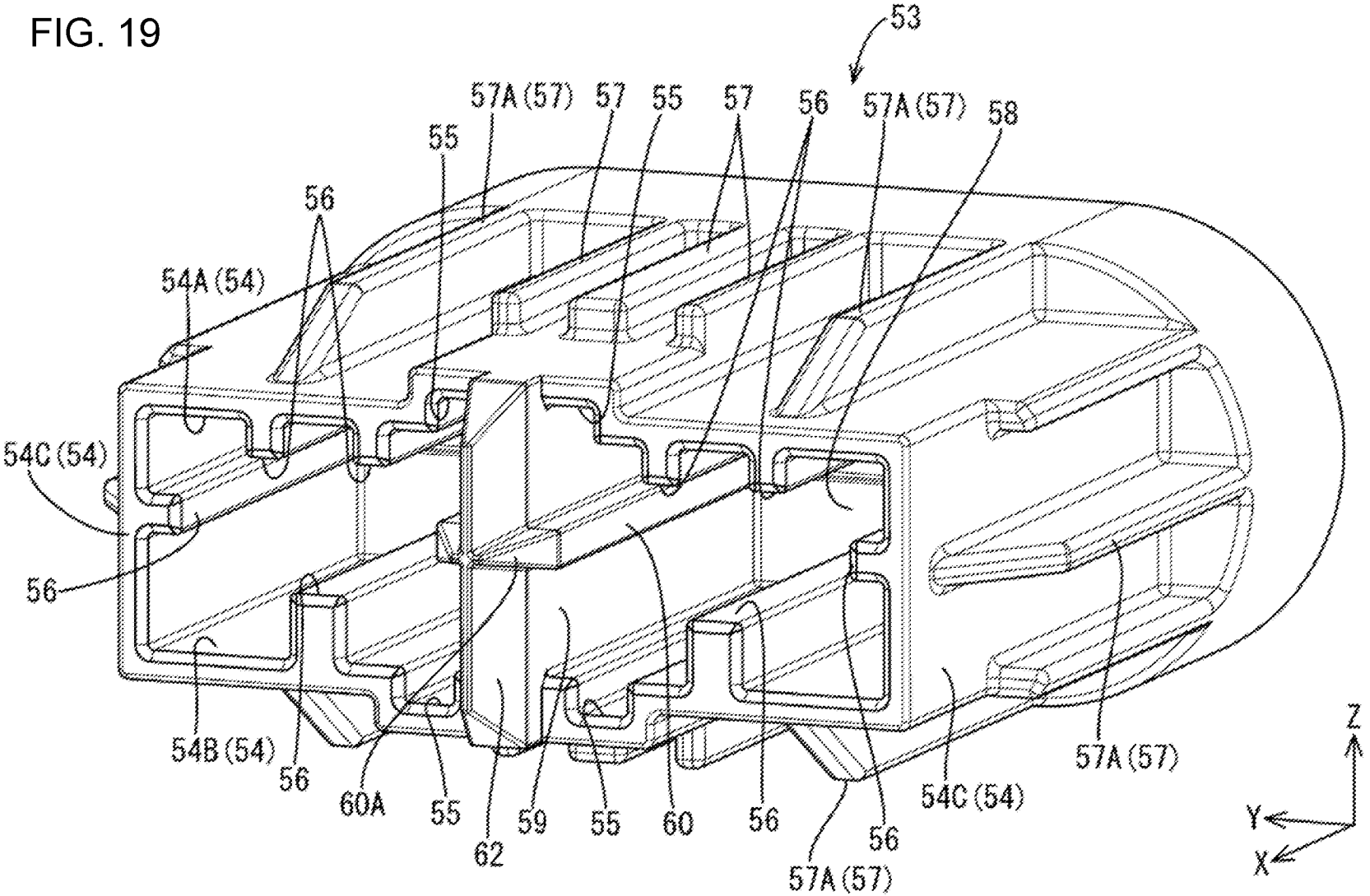
FIG. 19 is a perspective view showing the second housing.
Figure 20:
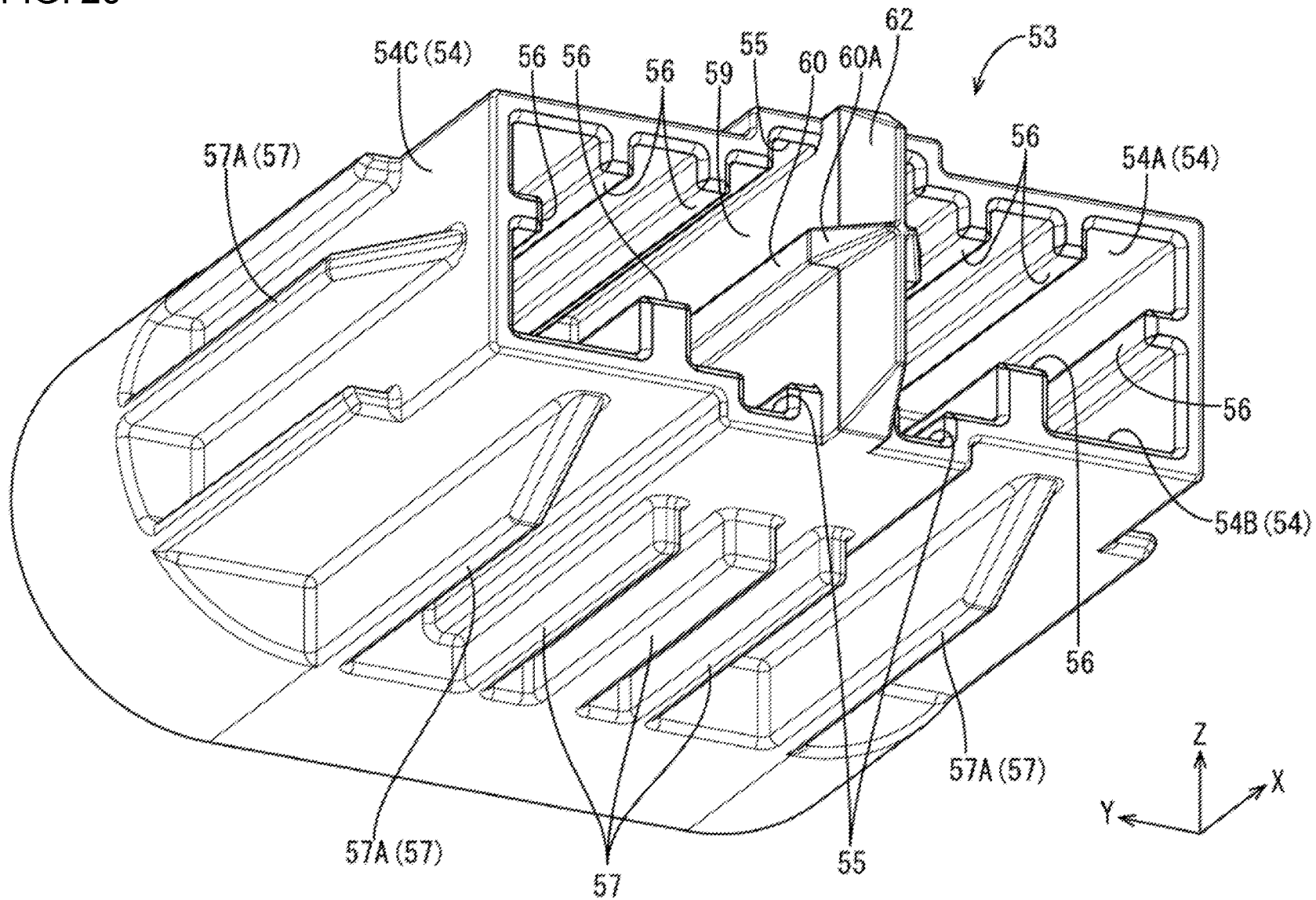
FIG. 20 is a perspective view showing the second housing from a direction different from that of FIG. 19.
Figure 21:
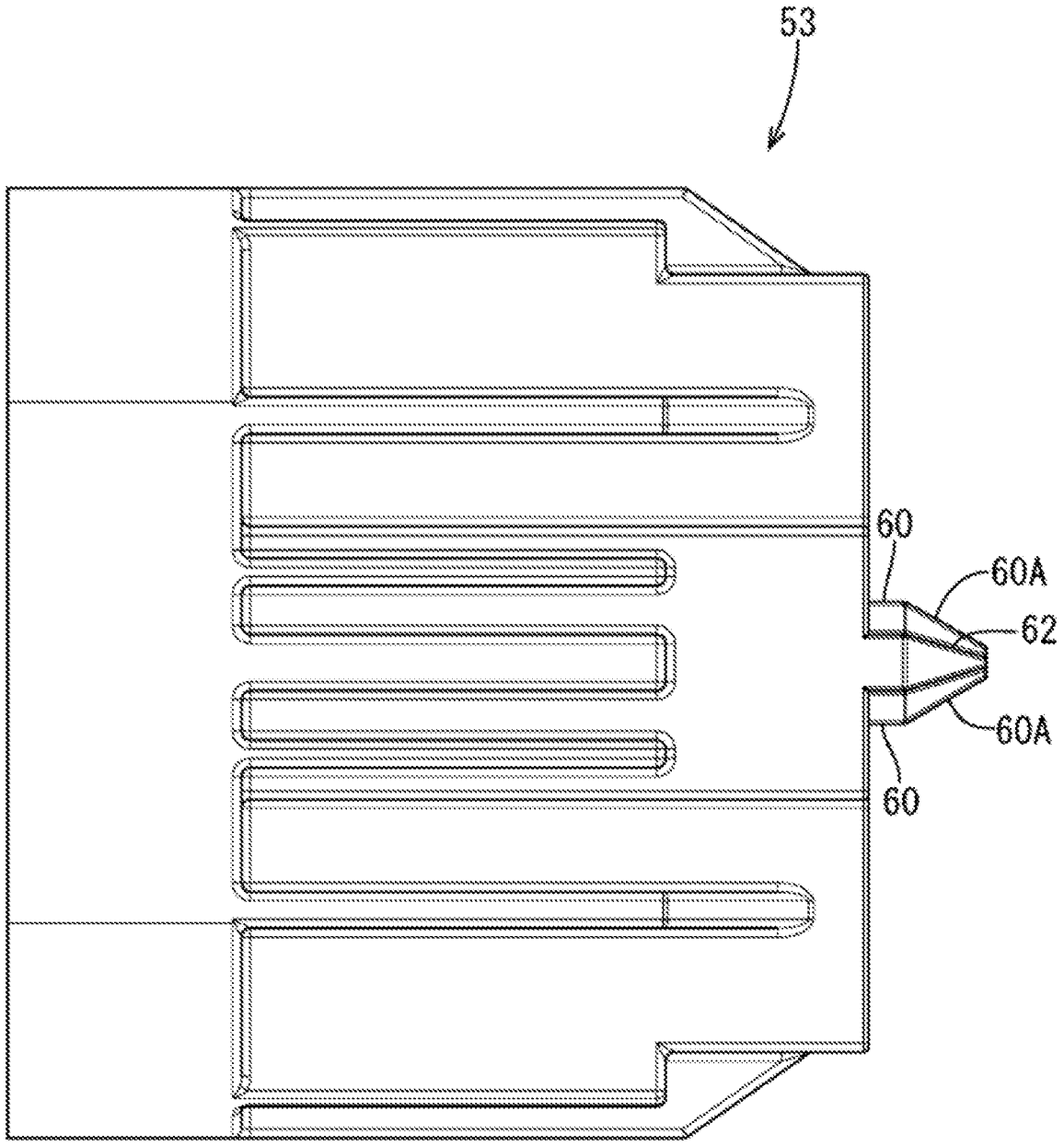
FIG. 21 is a plan view showing the second housing.
Figure 22:
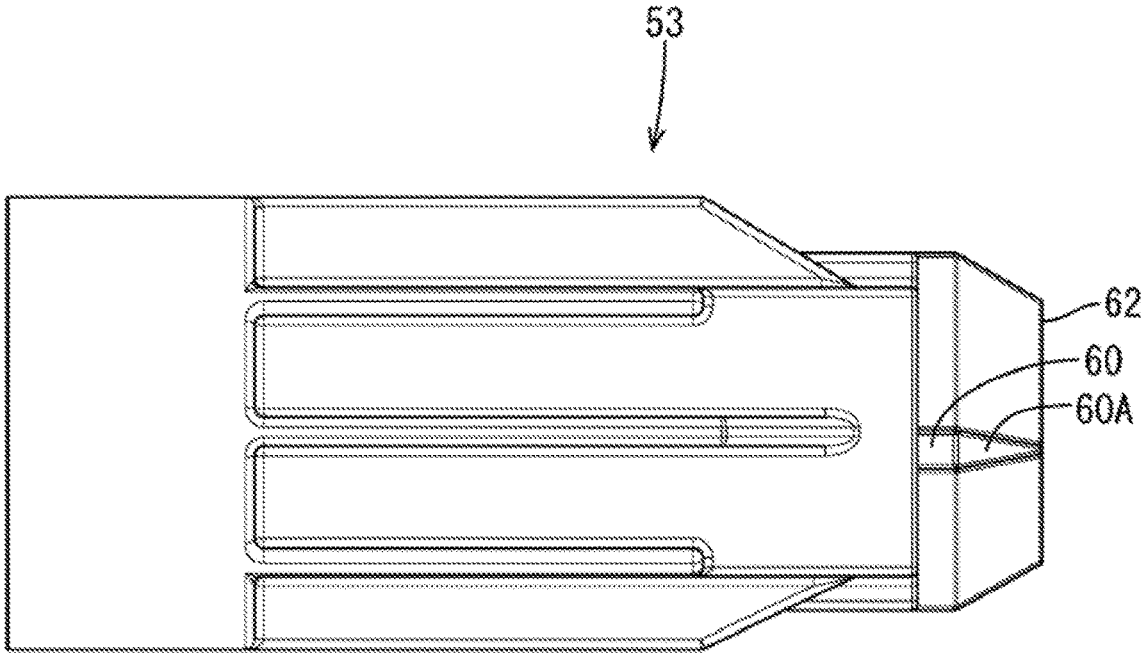
FIG. 22 is a side view showing the second housing.
Figure 23:
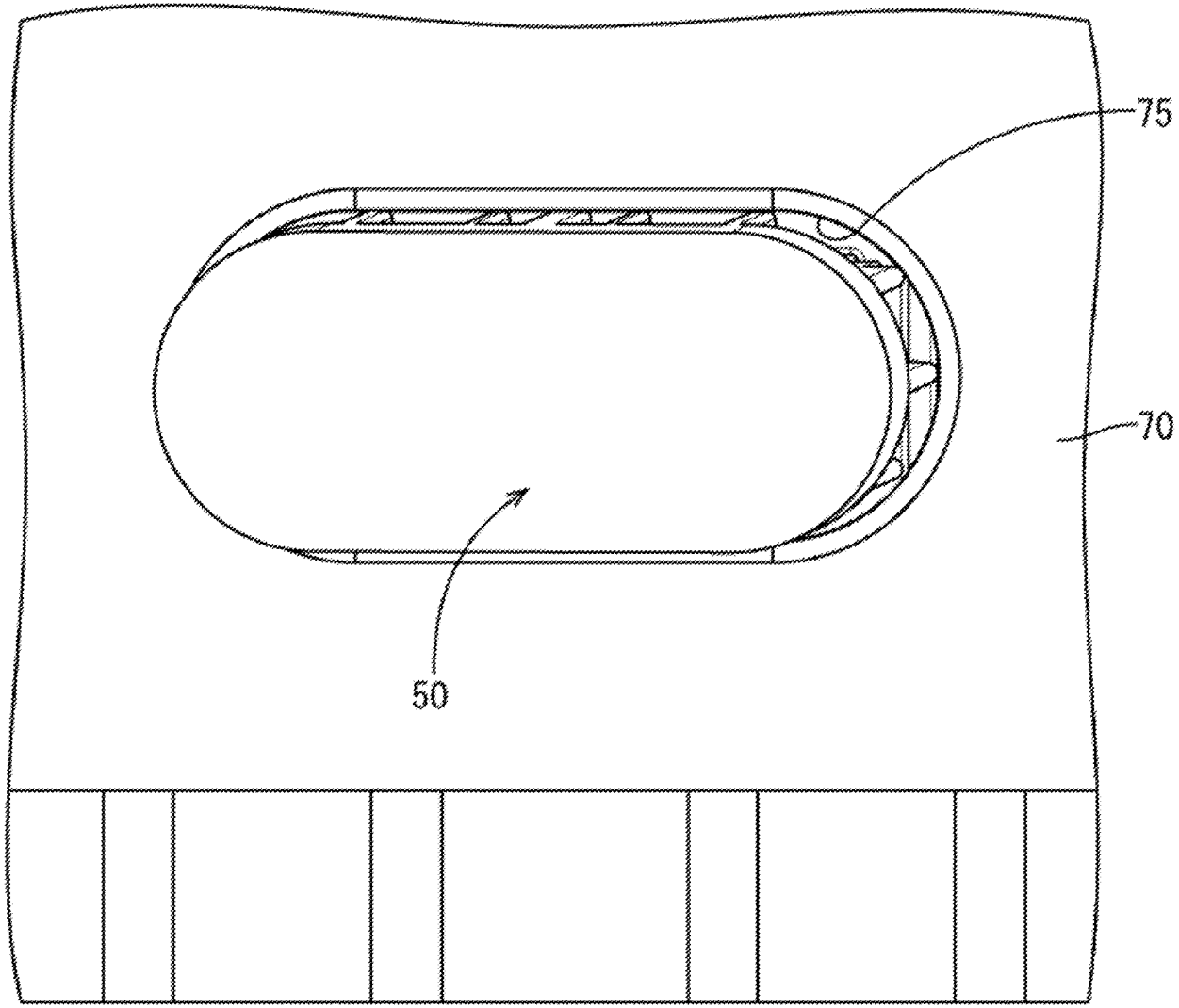
FIG. 23 is a back view at a position where a pry preventing protrusion comes into contact with an inclined surface of a first housing during a connecting operation of the first connector and the second connector.

The second housing 53 is made of insulating synthetic resin and, as shown in FIG. 28, includes the receptacle 54 having an opening, a back wall 58 for closing the receptacle 54, and a partition 59 partitioning the inside of the receptacle 54. As shown in FIGS. 19 and 20, the receptacle 54 is a wide rectangular tube. Fitting grooves 55 and fitting ribs 56 extend in the connecting direction on the inner surface of the receptacle 54. Ridges 57 are provided on the outer surface of the receptacle 54 and form plates extending in the connecting direction. The ridges 57 include two ridges 57A on the outer surface of each of facing walls 54A, 54B of the receptacle 54 vertically facing each other, and the ridges 57A on the outer surface of each of side walls 54C have tips inclined to gradually reduce a projecting dimension. The inclined tips of the ridges 57A guide the second housing 53 into the insertion hole 75.

The partition 59 is a flat plate in a laterally middle part in the receptacle 54, and upper and lower end parts of the partition 59 are coupled integrally to the facing walls 54A, 54B. Guided ridges 60 (an example of a "guided portion") extend in the connecting direction in vertically middle parts of both left and right surfaces of the partition wall 59 and are to be guided by sliding in the guide groove 33 of the first housing 23. The pry preventing protrusion 62 projects forward in front of the partition 59. The pry preventing protrusion 62 is tapered toward a tip, and projects from the entire front surface of the partition wall 59. Front end sides of the guided ridges 60 extend to both surfaces of the pry preventing protrusion 62 and are integrated with the pry preventing protrusion 62, and front parts of the guided ridges 60 have tapered portions 60A tapered toward the front.

The second housing 53 and the terminal accommodating member 24 may be such that the terminals and the housing are integral, for example, by press-fitting the terminals into press-fit holes of the housing or injecting resin into a mold by insert molding.

Next, an operation at the time of connecting the connector 10 is described.

As shown in FIG. 28, the arm 43 of the first connector 20 is bolted and fixed to the connector mounting portion 72 of the case 70. Then, the second connector 50 is inserted into the insertion hole 75 of the case 70 from the front. The second connector 50 inserted in the insertion hole 75 is movable in a range of a clearance CL between the inner wall of the insertion hole 75 and the ridges 57A on the outer surface of the receptacle 54 (see FIGS. 30 and 31). On the other hand, the terminal accommodating member 24 of the first connector 20 fixed to the case 70 of the device can deviate slightly positionally with respect to the extending member 40 by being coupled by the coupling 46.

Figure 25:
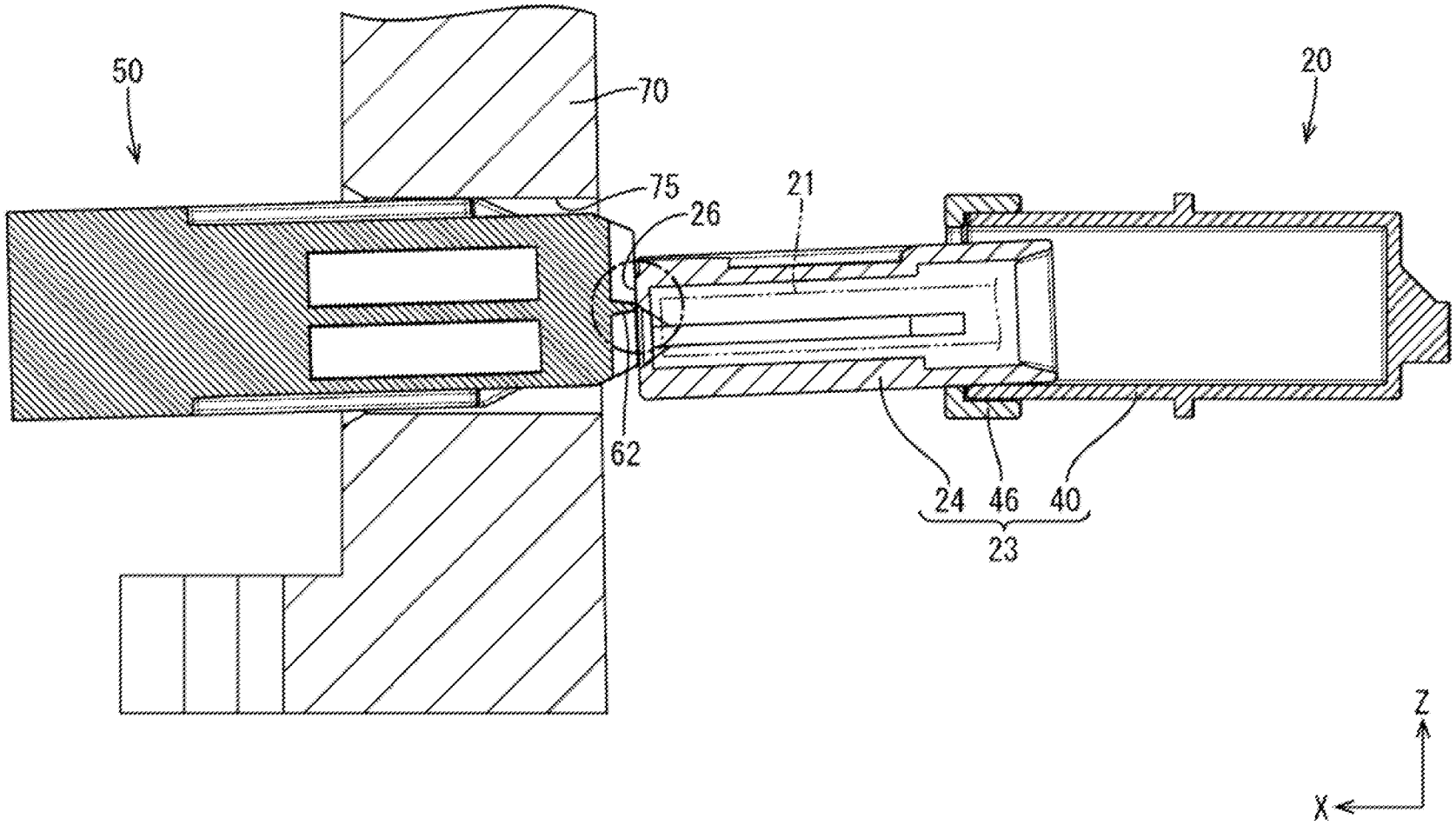
FIG. 25 is a section along E-E of FIG. 24.
Figure 26:
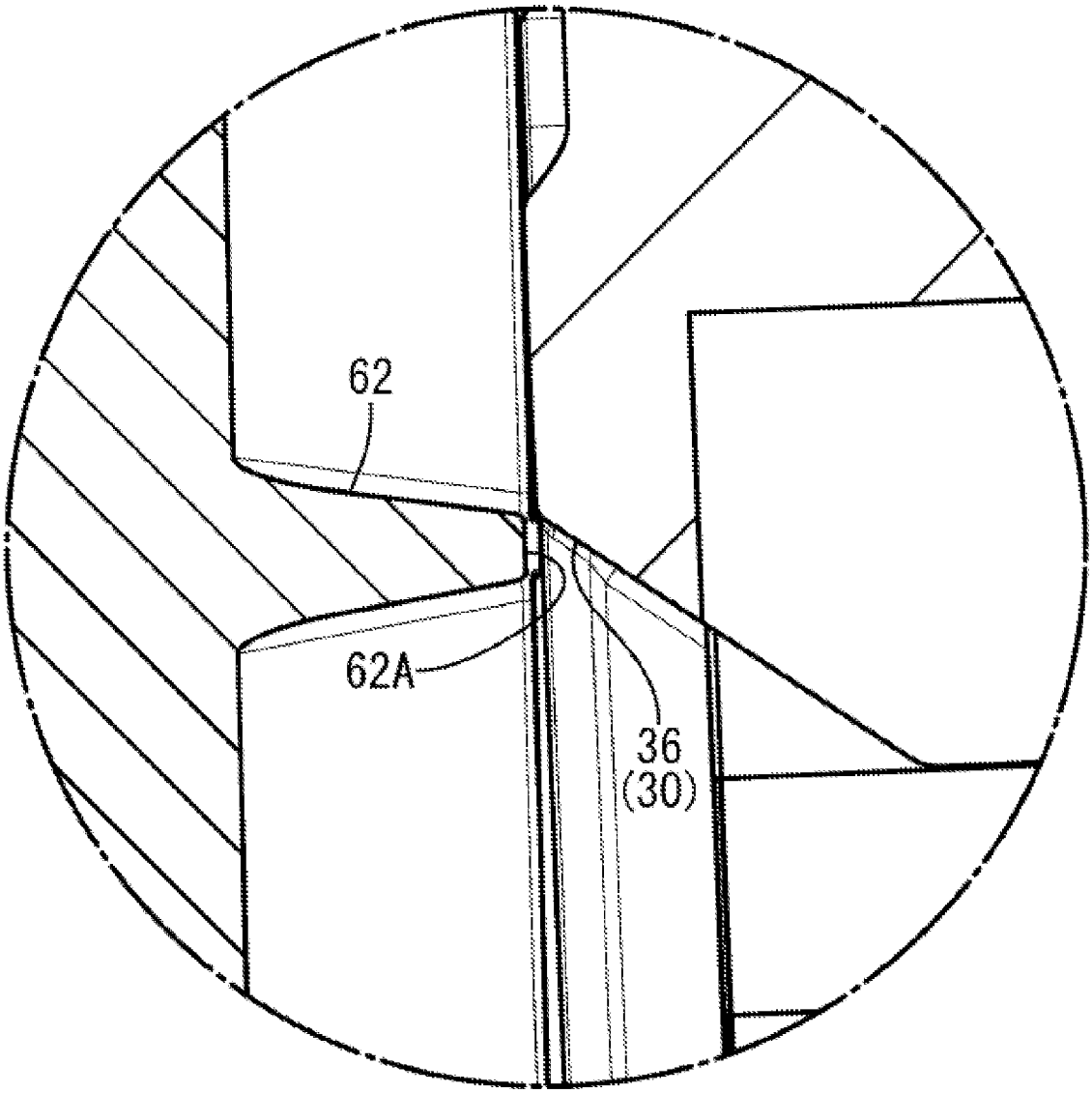
FIG. 26 is an enlarged view of a part of FIG. 25 where the pry preventing protrusion comes into contact with the inclined surface.
Figure 27:
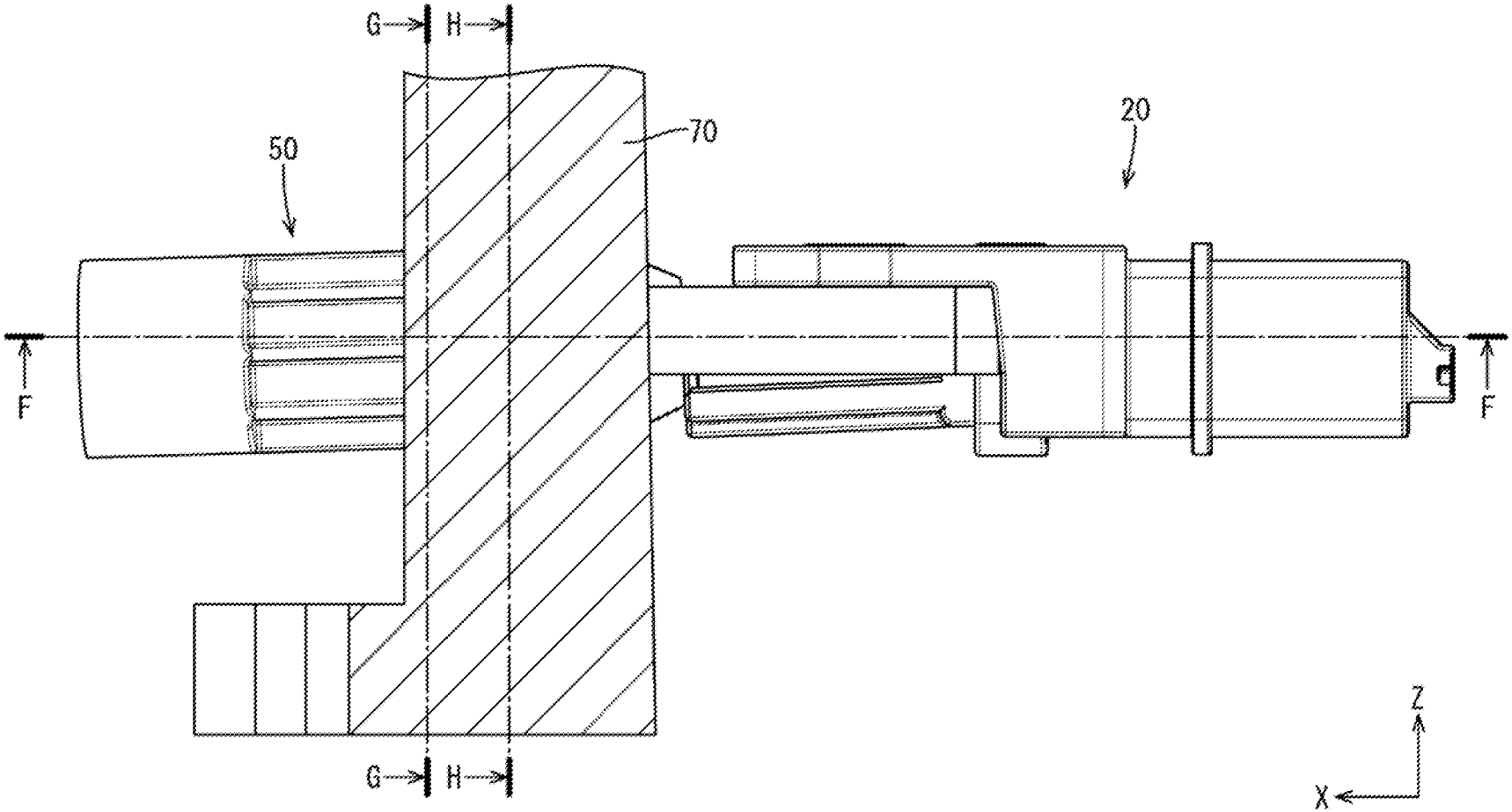
FIG. 27 is a side view at the position where the pry preventing protrusion comes into contact with the inclined surface of the first housing during the connecting operation of the first connector and the second connector.
Figure 29:
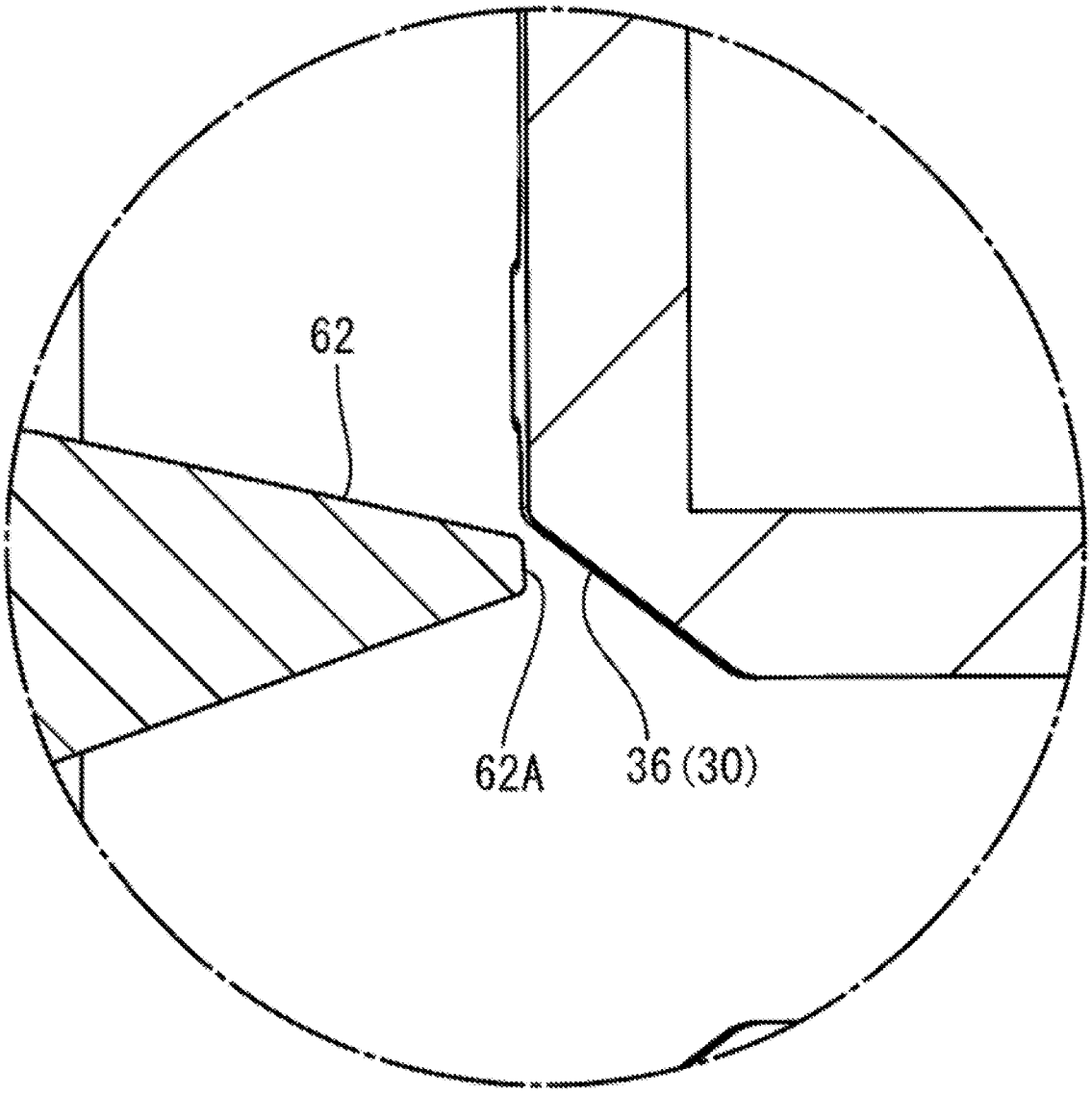
FIG. 29 is an enlarged view of a part of FIG. 28 where the pry preventing protrusion comes into contact with the inclined surface.
Figure 30:
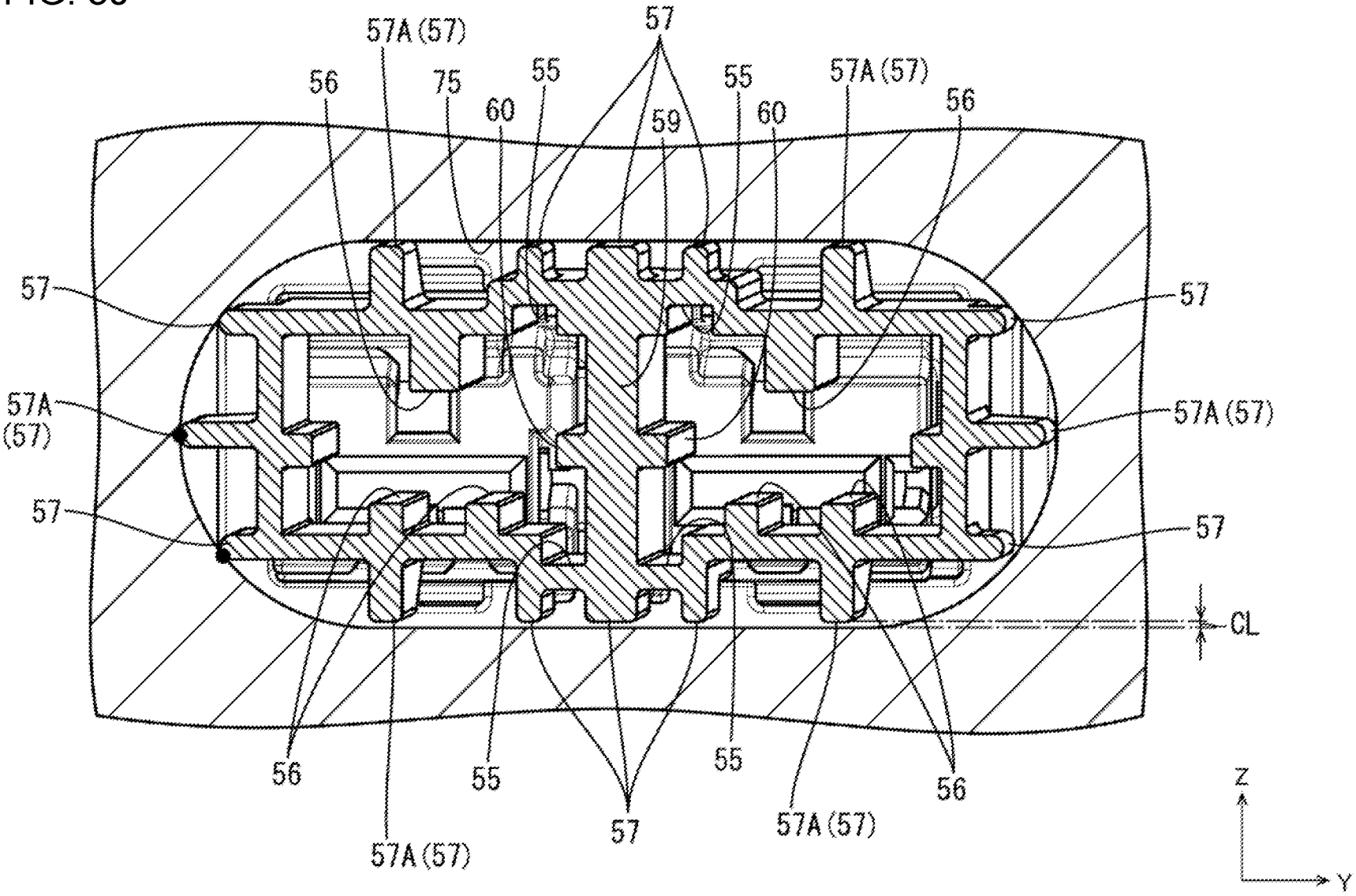
FIG. 30 is a section along G-G of FIG. 27.
Figure 31:
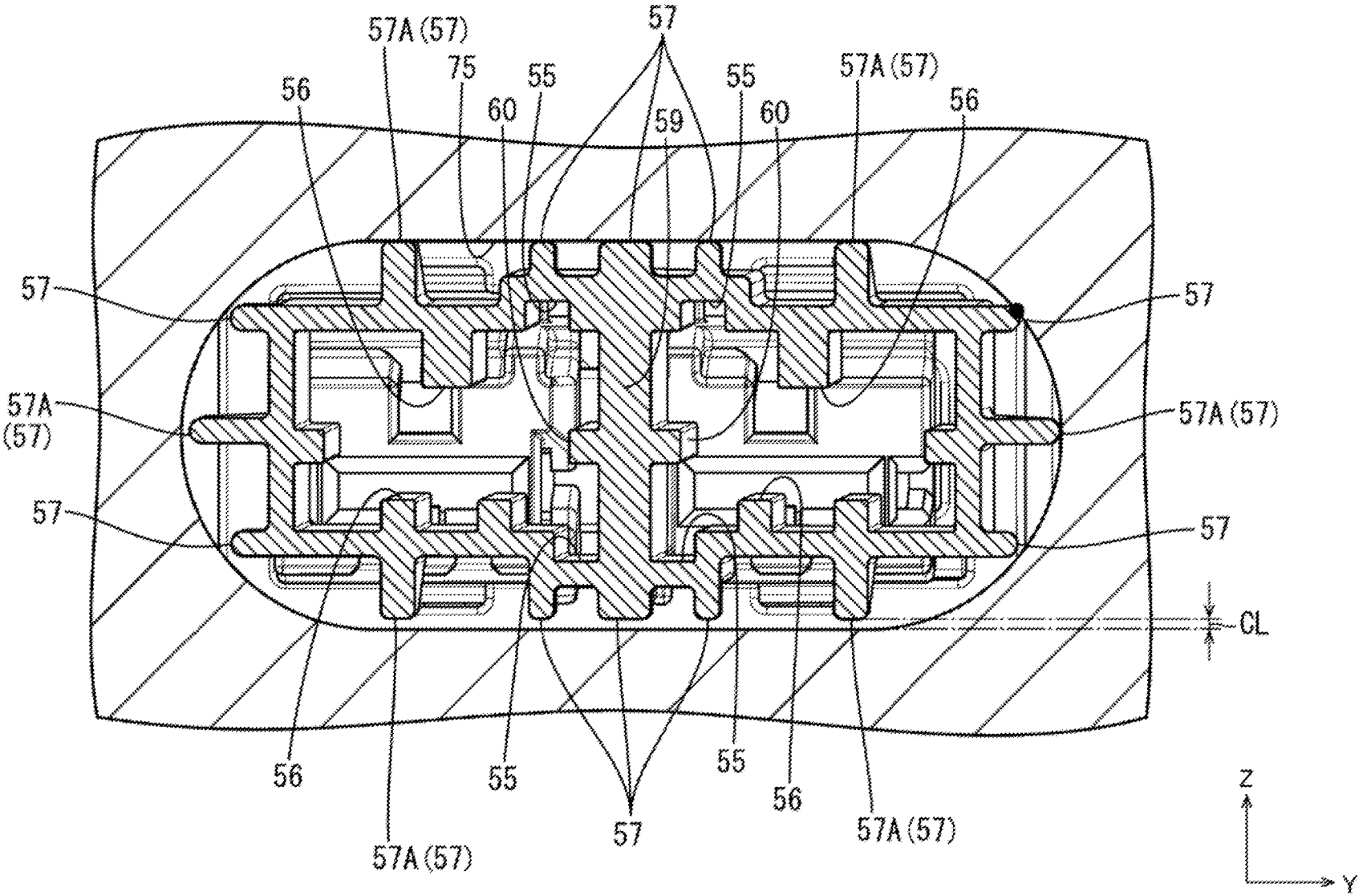
FIG. 31 is a section along H-H of FIG. 27.

When the second connector 50 is moved farther forward, the pry preventing protrusion 62 contacts a tip part of the first housing 23, as shown in FIGS. 25 and 28. Even if there is a positional deviation between the first housing 23 and the second housing 53 at this time, a tip 62A of the pry preventing protrusion 62 contacts edges of the inclined surfaces 36 of the first housing 23, as shown in FIGS. 26 and 29, so that the pry preventing protrusion 62 and the partition wall 59 are guided into the concave portion 30 to suppress both a positional deviation and a posture inclination of the second connector 50 with respect to the first connector 20. By connecting the second connector 50 to a proper position with respect to the first connector 20, the first terminals 21 and the second terminals 51 are in contact at proper positions and a case with connector (FIG. 1) in which the connector 10 is fixed to the case 70 is formed.

According to this embodiment, the following functions and effects are exhibited.

In the connector 10 has the first connector 20 and the second connector 50 that are to be connected. The first connector 20 includes the first terminals 21 and the first housing 23 configured to accommodate the first terminals 21. The second connector 50 includes the second terminals 51 and the second housing 53 configured to accommodate the second terminals 51 and has the receptacle 54 to be fit to the first housing 23. The concave portion 30 is provided on the side of the first housing 23 to be fit to the second housing 53, and the second housing 53 is provided with the pry preventing protrusion 62 projecting forward of the receptacle 54. The pry preventing protrusion 62 is configured to suppress a positional deviation of the second housing 53 with respect to the first housing 23 by entering the concave portion 30 during the connection of the first and second connectors 20 and the 50.

According to this embodiment, the pry preventing protrusion 62 projects forward of the receptacle 54 and can be inserted into the concave portion 30 to suppress a positional deviation of the second connector 50 with respect to the first connector 20 before the first housing 23 starts being fit into the receptacle 54. In this way, troubles caused by pry connection can be suppressed even without enlarging the receptacle, for example, as compared to the case where the pry connection is performed with the outer surface of the receptacle of the second connector engaged with the lock arm of the first connector. Thus, the pry connection can be suppressed while the configuration of the connector 10 is simplified. Further, the receptacle 54 need not be enlarged so that the amount of resin for forming the second housing can be reduced.

The second housing 53 includes the partition 59 partitioning the inside of the receptacle 54, and the pry preventing protrusion 62 is provided on the front part of the partition wall 59. By adopting this configuration, the pry preventing protrusion 62 can be provided by utilizing the configuration of the partition wall 59 provided to insulate the second terminals 51. Thus, the configuration of the second housing 53 can be simplified and the strength of the pry preventing protrusion 62 can be enhanced by the partition wall 59.

The concave portion 30 is provided with the guide groove 33 (guide) extending in the connecting direction of the first housing 23 and the second housing 53, and the pry preventing protrusion 62 is formed with the guided ridges 60 (guided portions) to be guided by being engaged with the guide groove 33 when the first housing 23 and the second housing 53 are connected. Thus, the connectors 20, 50 can be guided in the connecting direction by utilizing the configuration of the pry preventing protrusion 62.

The inclined surfaces 36 are formed on the inner wall of the concave portion 30 and extend obliquely to guide the pry preventing protrusion 62 into the concave portion 30 by coming into contact with the tip part of the pry preventing protrusion 62. By adopting this configuration, the pry preventing protrusion 62 can be guided into the concave portion 30 by the inclined surfaces 36 when the first and second connectors 20 and 50 are connected.

The first housing 23 is fixed to the case 70 of the device, the second housing 53 is inserted into the insertion hole 75 penetrating through the case 70, and the clearance CL is set between the inner wall of the insertion hole 75 and the outer surface of the second housing 53 so that the pry preventing protrusion 62 can come into contact with the concave portion 30. Thus, the second connector 50 can be inserted easily into the insertion hole 75 due to the clearance CL between the second connector 50 and the hole wall of the insertion hole 75 during a fitting operation of the second connector 50, and the pry connection can be prevented by the pry preventing protrusion 62 contacting the concave portion 30 even if the second connector 50 is positionally deviated or inclined due to the clearance CL.

The invention is not limited to the above described illustrated embodiment. For example, the following embodiments also are included in the scope of the invention.

Although the first connector 20 includes the female terminals and the second connector 50 includes the male terminals, there is no limitation to this and the first connector may include male terminals and the second connector may include female terminals.

Although the pry preventing protrusion 62 is provided on the partition 59, there is no limitation to this. For example, a pry preventing protrusion may be provided on a part other than the partition 59 in the receptacle 54 or a pry preventing protrusion projecting farther forward than the receptacle 54 may be provided on a front part of the receptacle 54 or on an outer surface side of the receptacle 54.

The shape of the pry preventing protrusion 62 is not limited to that of the above embodiment and can be changed into various shapes. For example, a pry preventing protrusion which is not tapered (has a substantially constant thickness) may be provided.

Although the concave portion 30 is provided with the inclined surfaces 36, there is no limitation to this and the concave portion 30 may be provided with no inclined surface 36.

LIST OF REFERENCE SIGNS

10: connector
20: first connector
21: first terminal
23: first housing
24: terminal accommodating member
30: concave portion
33: guide groove (guide)
36: inclined surface
40: extending member
46: coupling
50: second connector
51: second terminal
53: second housing
54: receptacle
59: partition
60: guided ridge (guided portion)
62: pry preventing protrusion
70: case
75: insertion hole

What is claimed is:

1. A connector, comprising a first connector and a second connector to be connected to each other, wherein:

the first connector includes a first terminal and a first housing configured to accommodate the first terminal;

the second connector includes a second terminal and a second housing configured to accommodate the second terminal and having a receptacle to be fit to the first housing, the second housing includes a partition configured to partition the inside of the receptacle;

a concave portion is provided on a side of the first housing to be fit to the second housing; and the second housing is provided with a pry preventing protrusion on a front part of the partition and projecting forwardly of the receptacle and configured to suppress a positional deviation of the second housing with respect to the first housing by entering the concave portion during a connecting operation.

2. The connector of claim 1, wherein:

the concave portion is provided with a guide extending in a connecting direction of the first housing and the second housing; and the pry preventing protrusion is formed with a guided portion to be guided by being engaged with the guide when the first housing and the second housing are connected.

3. The connector of claim 2, wherein an inclined surface is formed on an inner wall of the concave portion and is cut to guide the pry preventing protrusion into the concave portion by contacting a tip part of the pry preventing protrusion.

4. The connector of claim 3, wherein:

the first housing is fixed to a case of a device; and the second housing is inserted into an insertion hole penetrating through the case and a clearance is set between an inner wall of the insertion hole and an outer surface of the second housing so that the pry preventing protrusion comes into contact with the concave portion.

5. The connector of claim 1, wherein:

the concave portion is provided with a guide extending in a connecting direction of the first housing and the second housing; and the pry preventing protrusion is formed with a guided portion to be guided by being engaged with the guide when the first housing and the second housing are connected.

6. The connector of claim 1, wherein an inclined surface is formed on an inner wall of the concave portion and is cut to guide the pry preventing protrusion into the concave portion by contacting a tip part of the pry preventing protrusion.

7. The connector of claim 1, wherein:

the first housing is fixed to a case of a device; and the second housing is inserted into an insertion hole penetrating through the case and a clearance is set between an inner wall of the insertion hole and an outer surface of the second housing so that the pry preventing protrusion comes into contact with the concave portion.

* * * * *